US011578538B2

(12) United States Patent
Mahajan et al.

(10) Patent No.: US 11,578,538 B2
(45) Date of Patent: Feb. 14, 2023

(54) CUTTING ELEMENT WITH NONPLANAR FACE TO IMPROVE CUTTING EFFICIENCY AND DURABILITY

(71) Applicant: Schlumberger Technology Corporation, Sugar Land, TX (US)

(72) Inventors: Manoj Mahajan, Houston, TX (US); John Daniel Belnap, Lindon, UT (US); Xiaoge Gan, Houston, TX (US); Yi Fang, Orem, UT (US); Cheng Peng, Orem, UT (US); Lynn Belnap, Spanish Fork, UT (US); Youhe Zhang, Spring, TX (US); Michael George Azar, The Woodlands, TX (US); Venkatesh Karuppiah, The Woodlands, TX (US); Anthony LeBaron, Springville, UT (US); Xian Yao, Draper, UT (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 17/248,105

(22) Filed: Jan. 8, 2021

(65) Prior Publication Data

US 2021/0215003 A1 Jul. 15, 2021

Related U.S. Application Data

(60) Provisional application No. 62/985,632, filed on Mar. 5, 2020, provisional application No. 62/959,036, filed on Jan. 9, 2020.

(51) Int. Cl.

| | |
|---|---|
| ***E21B 10/567*** | (2006.01) |
| ***E21B 10/42*** | (2006.01) |
| *E21B 10/26* | (2006.01) |

(52) U.S. Cl.
CPC ..... *E21B 10/5673* (2013.01); *E21B 10/26* (2013.01); *E21B 10/42* (2013.01)

(58) Field of Classification Search
CPC ..... E21B 10/5671; E21B 10/5673
See application file for complete search history.

(56) References Cited

U.S. PATENT DOCUMENTS 3,381,349 A * 5/1968 Newcomer ..... B23B 27/1618 407/104
4,259,033 A * 3/1981 McCreery ..... B23B 27/145 407/114

(Continued)

FOREIGN PATENT DOCUMENTS

CN 205259954 U 5/2016
EP 3546692 A1 10/2019

(Continued)

OTHER PUBLICATIONS

Dictionary definition of "diamond", accessed May 4, 2022 via thefreedictionary.com.*

(Continued)

*Primary Examiner* — Blake Michener

(57) ABSTRACT

A cutting element has a cutting face at an opposite axial end from a base, a side surface extending from the base to the cutting face, an edge formed at the intersection between the cutting face and the side surface, and an elongated protrusion formed at the cutting face and extending between opposite sides of the edge, wherein the elongated protrusion has a geometry including a border extending around a concave surface and sloped surfaces extending between the border and the edge, and wherein the concave surface has a major axis dimension measured between opposite sides of the border and a minor axis dimension measured perpen- (Continued)

dicularly to the major axis dimension and ranging from 50 percent to 99 percent of the major axis dimension.

20 Claims, 16 Drawing Sheets

(56) References Cited

U.S. PATENT DOCUMENTS 4,558,753 A 12/1985 Barr
4,593,777 A 6/1986 Barr
4,852,671 A * 8/1989 Southland ..... E21B 10/61 175/430
5,054,246 A * 10/1991 Phaal ..... E21B 10/5673 51/307
5,076,739 A * 12/1991 Pano ..... B23B 27/045 D15/139
5,078,219 A * 1/1992 Morrell ..... E21B 10/44 299/111
5,180,258 A * 1/1993 Bernadic ..... B23B 27/143 D15/139
5,558,170 A * 9/1996 Thigpen ..... E21B 17/1092 175/57
5,626,189 A * 5/1997 Hutchinson ..... E21B 29/00 166/55.6
5,706,906 A 1/1998 Jurewicz et al.
6,000,483 A 12/1999 Jurewicz et al.
6,050,354 A * 4/2000 Pessier ..... E21B 10/567 175/425
6,202,770 B1 3/2001 Jurewicz et al.
6,412,580 B1 * 7/2002 Chaves ..... E21B 10/5673 175/432
6,550,556 B2 4/2003 Middlemiss et al.
6,935,444 B2 8/2005 Lund et al.
7,188,692 B2 3/2007 Lund et al.
7,363,992 B2 * 4/2008 Stowe ..... E21B 29/06 175/426
7,681,673 B2 * 3/2010 Kolachalam ..... E21B 10/16 175/430
7,726,420 B2 6/2010 Shen et al.
7,757,785 B2 7/2010 Zhang et al.
7,798,257 B2 9/2010 Shen et al.
8,037,951 B2 10/2011 Shen et al.
8,087,478 B2 * 1/2012 Patel ..... E21B 10/5673 175/57
8,191,656 B2 * 6/2012 Dourfaye ..... E21B 10/573 175/428
8,434,572 B2 * 5/2013 Stowe, II ..... E21B 10/56 175/428
8,499,860 B2 8/2013 Shen et al.
8,684,112 B2 4/2014 DiGiovanni et al.
8,783,387 B2 7/2014 Durairajan et al.
8,833,492 B2 9/2014 Durairajan et al.
8,919,462 B2 12/2014 DiGiovanni et al.
8,936,109 B2 * 1/2015 Stowe, II ..... E21B 10/54 175/428
8,991,523 B2 * 3/2015 Shen ..... E21B 10/633 175/413
9,103,174 B2 8/2015 DiGiovanni
9,145,743 B2 9/2015 Shen et al.
RE45,748 E 10/2015 Zhang et al.
9,243,452 B2 * 1/2016 DiGiovanni ..... E21B 7/00
9,278,395 B2 * 3/2016 Matsuo ..... B23C 5/109
9,303,461 B2 4/2016 Patel et al.
9,316,058 B2 4/2016 Bilen et al.
9,376,867 B2 6/2016 DiGiovanni et al.
9,415,447 B2 * 8/2016 Myers ..... B24D 3/06
9,428,966 B2 8/2016 Patel et al.
9,482,057 B2 11/2016 DiGiovanni et al.
9,617,792 B2 4/2017 DiGiovanni et al.
9,650,837 B2 5/2017 Patel et al.
10,006,253 B2 6/2018 DiGiovanni et al.
10,017,998 B2 7/2018 Bilen et al.
10,022,840 B1 * 7/2018 Miess ..... E21B 10/567
10,066,442 B2 9/2018 Patel et al.
10,125,552 B2 11/2018 Zhao et al.
10,240,399 B2 3/2019 Rahmani
10,280,688 B2 5/2019 Dunbar et al.
10,287,825 B2 5/2019 Chen et al.
10,309,156 B2 6/2019 Azar et al.
10,337,255 B2 7/2019 DiGiovanni et al.
10,385,623 B2 8/2019 DiGiovanni et al.
10,428,590 B2 10/2019 DiGiovanni et al.
10,428,591 B2 10/2019 Patel et al.
10,563,464 B2 2/2020 Davila et al.
10,577,870 B2 * 3/2020 Izbinski ..... E21B 10/567
10,801,268 B2 10/2020 Rahmani et al.
2005/0263327 A1 * 12/2005 Meiners ..... E21B 10/52 175/430
2007/0235230 A1 10/2007 Cuillier et al.
2008/0006446 A1 * 1/2008 Stowe ..... E21B 10/5673 175/263
2008/0264696 A1 10/2008 Dourfaye et al.
2010/0084198 A1 * 4/2010 Durairajan ..... E21B 10/55 175/425
2010/0243334 A1 9/2010 Dourfaye et al.
2011/0259642 A1 * 10/2011 DiGiovanni ..... B24D 18/00 175/57
2013/0262048 A1 3/2013 Tang
2014/0116788 A1 * 5/2014 Patel ..... E21B 10/573 175/428
2014/0182947 A1 7/2014 Bhatia et al.
2015/0259988 A1 9/2015 Chen et al.
2017/0234078 A1 * 8/2017 Patel ..... E21B 10/55 175/430
2017/0284161 A1 * 10/2017 Zhang ..... E21B 10/5735
2018/0334860 A1 11/2018 Azar et al.
2019/0071933 A1 3/2019 Gan et al.
2019/0106943 A1 4/2019 Tilleman et al.
2019/0178038 A1 6/2019 Rahmani
2019/0203539 A1 7/2019 Zhao et al.
2019/0264511 A1 8/2019 Chen et al.
2019/0368276 A1 12/2019 Zhao et al.
2019/0368277 A1 12/2019 Zhao et al.
2020/0032589 A1 * 1/2020 Izbinski ..... E21B 10/5673
2021/0370419 A1 * 12/2021 Yu ..... E21B 10/5673

FOREIGN PATENT DOCUMENTS

WO 2018231343 A1 12/2018
WO 2020055882 A1 3/2020

OTHER PUBLICATIONS

Shetty, D.K. et al., "Biaxial Flexure Tests for Ceramics", American Ceramic Society Bulletin, 1980, 59(12), pp. 1193-1197.
International Search Report and Written Opinion issued in International Patent application PCT/US2021/012591, dated Apr. 29, 2021, 14 pages.
International Preliminary Report on Patentability issued in International Patent application PCT/US2021/012591 dated Jul. 21, 2022, 8 pages.

* cited by examiner

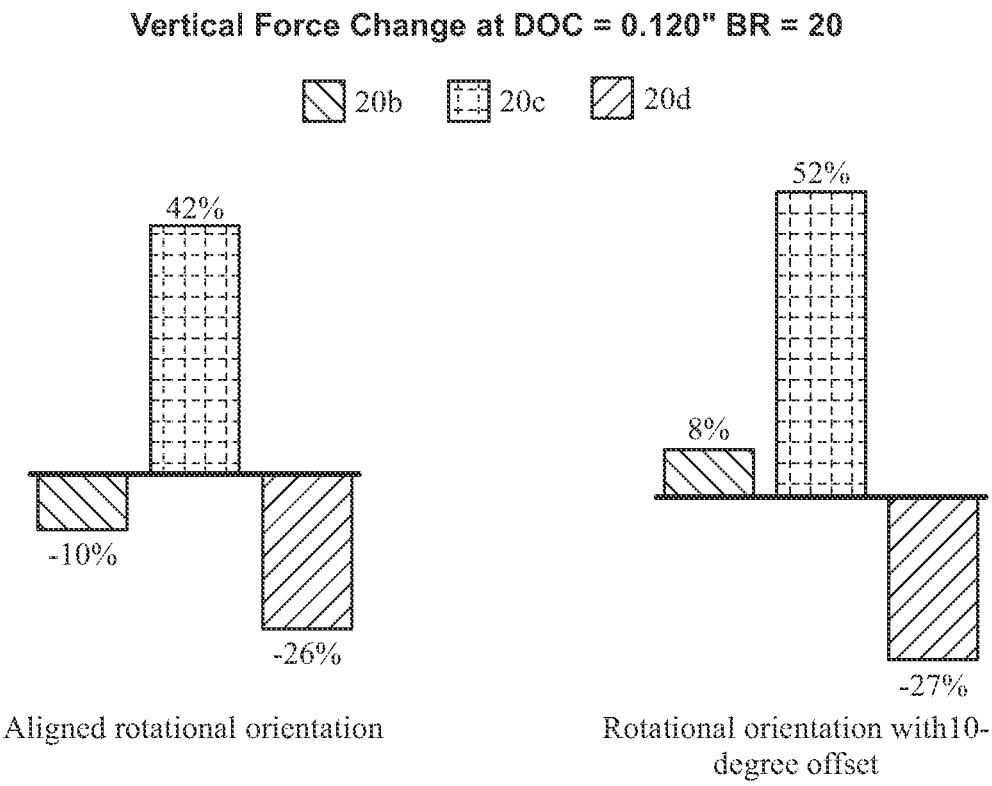
FIG. 20
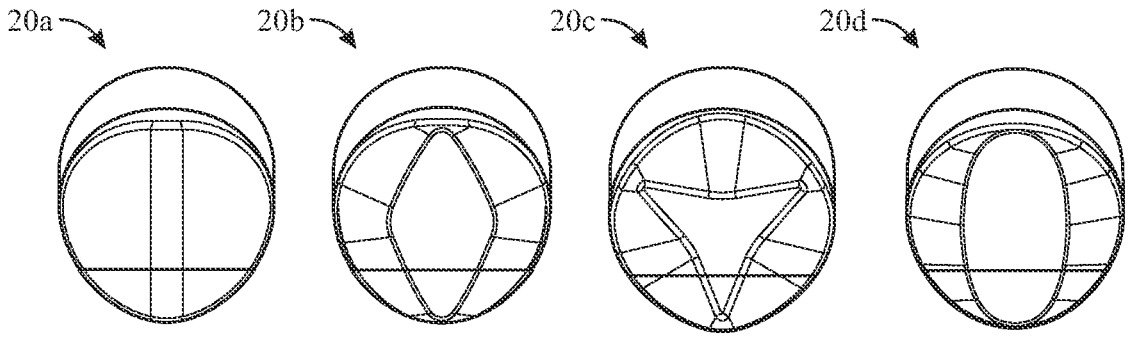
FIG. 21 (Prior Art)
FIG. 22
FIG. 23
FIG. 24

CUTTING ELEMENT WITH NONPLANAR FACE TO IMPROVE CUTTING EFFICIENCY AND DURABILITY

CROSS-REFERENCE TO RELATED APPLICATIONS

This application claims the benefit of, and priority to, U.S. Patent Application No. 62/959,036 filed on Jan. 9, 2020, and U.S. Patent Application No. 62/985,632 filed on Mar. 5, 2020, which are both incorporated herein by reference in their entirety.

BACKGROUND

Cutting elements used in down-hole drilling operations are often made with a super hard material layer to penetrate hard and abrasive earthen formations. For example, cutting elements may be mounted to drill bits (e.g., rotary drag bits), such as by brazing, for use in a drilling operation. FIG. 1 shows an example of a fixed cutter drill bit 10 (sometimes referred to as a drag bit) having a plurality of cutting elements 18 mounted thereto for drilling a formation. The drill bit 10 includes a bit body 12 having an externally threaded connection at one end 14, and a plurality of blades 16 extending from the other end of bit body 12 and forming the cutting surface of the bit 10. A plurality of cutters 18 are attached to each of the blades 16 and extend from the blades to cut through earth formations when the bit 10 is rotated during drilling. The cutters 18 may deform the earth formation by scraping, crushing, and shearing.

Super hard material layers of a cutting element may be formed under high temperature and pressure conditions, usually in a press apparatus designed to create such conditions, cemented to a carbide substrate containing a metal binder or catalyst such as cobalt. For example, polycrystalline diamond (PCD) is a super hard material used in the manufacture of cutting elements, where PCD cutters typically comprise diamond material formed on a supporting substrate (typically a cemented tungsten carbide (WC) substrate) and bonded to the substrate under high temperature, high pressure (HTHP) conditions.

A PCD cutting element may be fabricated by placing a cemented carbide substrate into a container or cartridge with a layer of diamond crystals or grains loaded into the cartridge adjacent one face of the substrate. A number of such cartridges are typically loaded into a reaction cell and placed in the HPHT apparatus. The substrates and adjacent diamond grain layers are then compressed under HPHT conditions which promotes a sintering of the diamond grains to form a polycrystalline diamond structure. As a result, the diamond grains become mutually bonded to form a diamond layer over the substrate interface. The diamond layer is also bonded to the substrate interface.

Such cutting elements are often subjected to intense forces, torques, vibration, high temperatures and temperature differentials during operation. As a result, stresses within the structure may begin to form. Drag bits for example may exhibit stresses aggravated by drilling anomalies during well boring operations such as bit whirl or bounce often resulting in spalling, delamination or fracture of the super hard material layer or the substrate thereby reducing or eliminating the cutting elements efficacy and decreasing overall drill bit wear life.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments of the present disclosure relate to cutting elements having a cutting face at an opposite axial end from a base, a side surface extending from the base to the cutting face, an edge formed at the intersection between the cutting face and the side surface, and an elongated protrusion formed at the cutting face and extending between opposite sides of the edge, wherein the elongated protrusion has a geometry including a border extending around a concave surface and sloped surfaces extending between the border and the edge, and wherein the concave surface has a major axis dimension measured between opposite sides of the border and a minor axis dimension measured perpendicularly to the major axis dimension and ranging from 50 percent to 99 percent of the major axis dimension.

In another aspect, embodiments of the present disclosure relate to downhole cutting tools that include a plurality of blades extending outwardly from a body, a plurality of cutting elements disposed in pockets formed along a blade cutting edge of each of the plurality of blades, a cutting profile formed by an outline of the plurality of cutting elements mounted to the plurality of blades when rotated into a single plane, wherein at least one of the cutting elements is a directional cutting element having a cutting face with an elongated protrusion extending linearly along a major axis dimension and an edge formed around the cutting face at an intersection between the cutting face and a side surface of the directional cutting element, wherein an exposed portion of the edge forming part of the cutting profile extends a partial arc length around the edge, and wherein the directional cutting element is rotationally oriented within one of the pockets such that the major axis dimension intersects with a midpoint of the partial arc length.

In another aspect, embodiments of the present disclosure relate to methods including preparing a cutting profile of a downhole tool having a plurality of blades extending outwardly from a body and a plurality of cutting elements disposed in pockets formed along a blade cutting edge of each of the blades, wherein the cutting profile includes an outline of the cutting elements when rotated into a single plane view, determining an exposed area on a cutting face of at least one of the cutting elements in the cutting profile, wherein the exposed area on the cutting face is nonoverlapping with adjacent cutting elements in the cutting profile when rotated into the single plane view, defining a rolling rake axis extending radially outward from a longitudinal axis of the at least one cutting element based at least in part on the exposed area, orienting a directional cutting element on the downhole tool, wherein the directional cutting element has at least one protrusion spaced azimuthally around an edge of the cutting face, and wherein one of the at least one protrusion aligns with the rolling rake axis.

In yet another aspect, embodiments of the present disclosure relate to methods including determining radial forces on a plurality of cutting elements disposed on a blade of a cutting tool, wherein the cutting elements have at least one protrusion formed on a cutting face of the cutting element and wherein the radial forces include an outward radial force in a direction from a rotational axis of the cutting tool toward the outer diameter of the cutting tool and an inward radial force in an opposite direction from the outward radial force, calculating a net radial force on each of the cutting elements, wherein the net radial force equals the sum of the outward radial force and the inward radial force on each cutting element, adding the net radial force of the plurality of cutting elements to calculate a blade net radial force, and reducing the blade net radial force by rotating at least one of the plurality of cutting elements.

Other aspects and advantages of the claimed subject matter will be apparent from the following description and the appended claims.

BRIEF DESCRIPTION OF DRAWINGS

FIG. 20 shows a graph comparing changes in vertical forces on different types of directional cutting elements.

FIGS. 21-24 show the directional cutting elements compared in the graph of FIG. 20.

DETAILED DESCRIPTION

In one aspect, embodiments disclosed herein relate to directional cutting elements (which may also be referred to as directional cutters) and their orientation on a cutting tool. As used herein, a directional cutting element may include a cutting element having a cutting face with varied surface geometry around its perimeter. The varied surface geometry may generate different cutting forces when contacting a working surface depending on the rotational orientation of the cutting face with respect to the working surface. Thus, cutting efficiency and performance of directional cutting elements may be rotationally dependent on their orientation on a cutting tool. In another aspect, embodiments disclosed herein relate to optimization of the rotational orientation of directional cutting elements (and the directional geometries formed on their cutting face) on downhole cutting tools.

Figure 2:
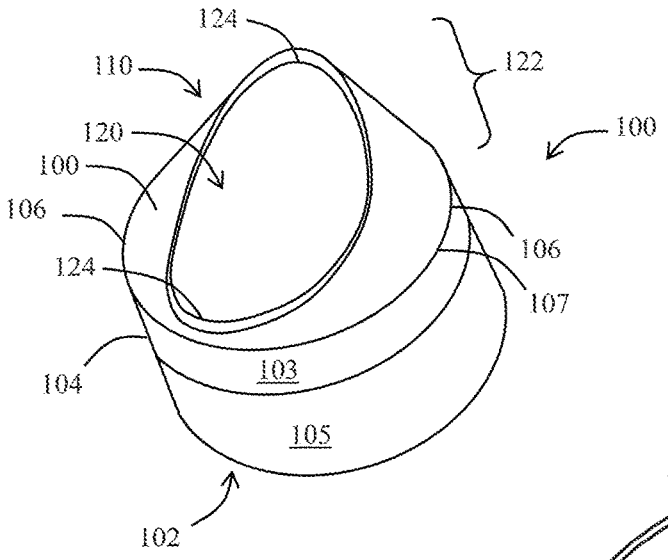
FIG. 2 shows a perspective view of a directional cutting element according to embodiments of the present disclosure.
Figure 3:
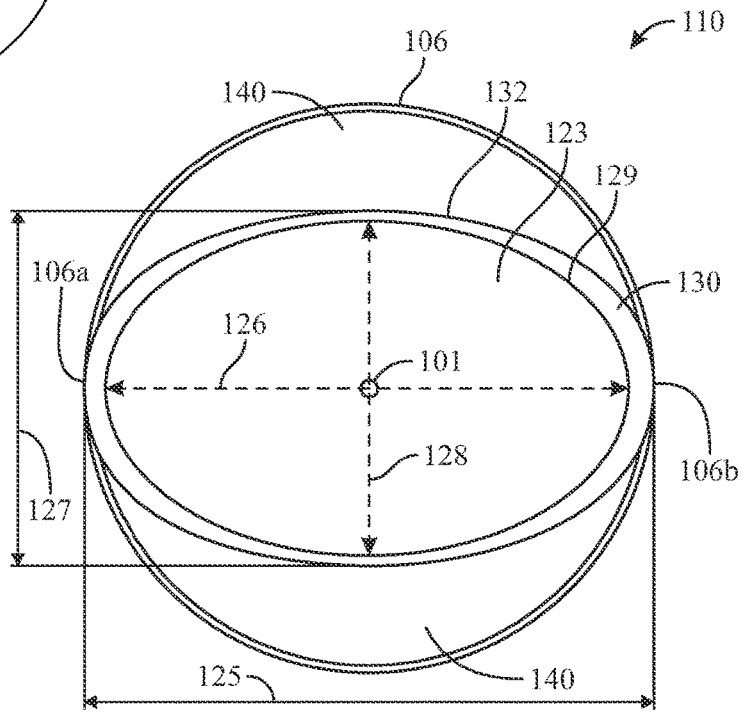
FIG. 3 shows a top view of the directional cutting element in FIG. 2.
Figure 4:
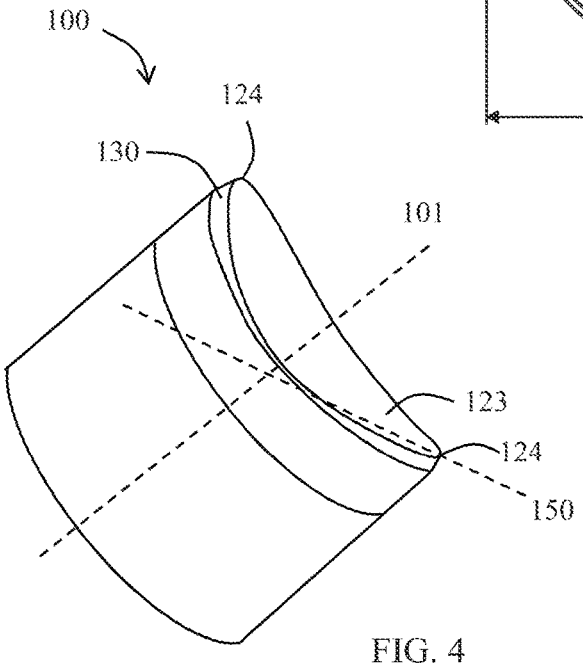
FIG. 4 shows a side view of the directional cutting element in FIGS. 2 and 3.

FIGS. 2-4 show an example of a directional cutting element 100 according to embodiments of the present disclosure, where FIG. 2 is a perspective view, FIG. 3 is a top view, and FIG. 4 is a side view of the directional cutting element 100. The directional cutting element 100 includes a longitudinal axis 101, a cutting face 110 at an opposite axial end from a base 102, and a side surface 104 extending from the base 102 to the cutting face 110. An edge 106 is formed at the intersection between the cutting face 110 and the side surface 104.

Further, the directional cutting element 100 may be formed of an ultrahard material table 103 (e.g., a diamond table) disposed on a substrate 105, where the cutting face 110 is formed on the ultrahard material table 103. The ultrahard material layer or table 103 may be formed under high temperature and high-pressure conditions, usually in a high pressure, high temperature (HPHT) press apparatus designed to create such conditions, and attached to the substrate 105 (e.g., a cemented carbide substrate such as cemented tungsten carbide containing a metal binder or catalyst such as cobalt). The substrate is often less hard than the ultrahard material to which it is bound. Some examples of ultrahard materials include cemented ceramics, diamond, polycrystalline diamond, and cubic boron nitride.

An elongated protrusion 120 is a raised elongated shape formed along the cutting face 110, raised an axial height 122 from an axially lowest point 107 around the edge 106 of the cutting element 100 to an axially tallest point 124 of the cutting face 110, where the axially lowest point 107 (or points) refers to the point axially closest to the base 102 of the cutting element 100, and the axially tallest point 124 (or points) refers to the point axially farthest from the base 102 of the cutting element 100. In the embodiment shown, the axially tallest points 124 of the cutting face 110 may be at opposite ends of the elongated protrusion 120, where a top surface 123 of the elongated protrusion 120 is concave and slopes from the tallest points 124 in a downward axial direction toward the base 102 and in a radially inward direction toward the longitudinal axis 101. Further, in the embodiment shown, the edge 106 extends around the cutting face 110 at the same axial distance from the base 102, and thus, is at the same axially lowest point 107 around the entire edge 106. The axially tallest points 124 of the cutting face 110 extend a height above the axially lowest point of the concave top surface 123 that is less than or equal to the axial height 122. That is, the axially lowest point of the concave top surface 123 may be axially at the same level as the axially lowest point 107 around the edge 106. In some embodiments, the axially lowest point of the concave top surface 123 range from between 1 percent to 100 percent, between 5 percent to 50 percent, or between 10 percent to 30 percent of the axial height 122.

The elongated protrusion 120 may extend a linear distance 125 along a major axis 126 and between opposite sides 106*a*, 106*b* of the edge 106. The elongated protrusion 120 may also have a width 127 measured along a minor axis 128, where the minor axis 128 is perpendicular to the major axis 126. Both the major axis 126 and the minor axis 128 may be transverse to the longitudinal axis 101 of the cutting element 100. According to embodiments of the present disclosure, the width 127 of the elongated protrusion 120 may range between 50 percent and 99 percent of the linear distance 125, e.g., between 60 percent and 90 percent of the linear distance 125, between 65 percent and 80 percent of the linear distance 125, and other subranges thereof.

The geometry of the elongated protrusion 120 may further be described in terms of the shape of its top surface 123 geometry. The top surface 123 of an elongated protrusion 120 may be a concave surface defined by a border 129, which may be a transition or sharp change in slope from the top surface 123 slope. For example, in the embodiment shown in FIGS. 2-4, the border 129 around the top surface 123 of the elongated protrusion 120 is formed at the intersection between the top surface 123 and a face chamfer 130 formed around the border 129. Sloped surfaces 140 may extend from an outer perimeter 132 of the face chamfer 130 to the edge 106 of the cutting element 100. In the embodiment shown, the face chamfer 130 and the sloped surfaces 140 may have different slopes, but both slope in an axial direction from the border 129 of the top surface 123 toward the base 102 of the cutting element 100 and in a radially outward direction from the longitudinal axis 101 toward the edge 106 of the cutting element 100. The outer perimeter 132 of the face chamfer 130 may be formed at the intersection between the sloped surfaces 140 and the face chamfer 130.

For clarity in use of terms, the sloped surfaces 140, the face chamfer 130 and the top surface 123 each form part of the cutting face 120. For example, in the embodiment of FIGS. 2-4, the top surface 123 is a concave portion of the cutting face 120.

Further, in the embodiment shown, the border 129 around the top surface 123 of the elongated protrusion 120 is in the shape of an ellipse. However, in some embodiments, an elongated protrusion may have a border defining a top surface that is in the shape of a diamond or other shape with linear extensions extending outwardly from a central region (e.g., a multi-point star shape).

According to embodiments of the present disclosure, a concave surface forming a top surface of an elongated protrusion may provide the cutting element with a front rake angle ranging from 5 to 45 degrees, where a front rake angle is measured between a radial plane perpendicular to a longitudinal axis of the cutting element and a tangent line to the concave surface proximate to the edge of the cutting element.

Figure 5:
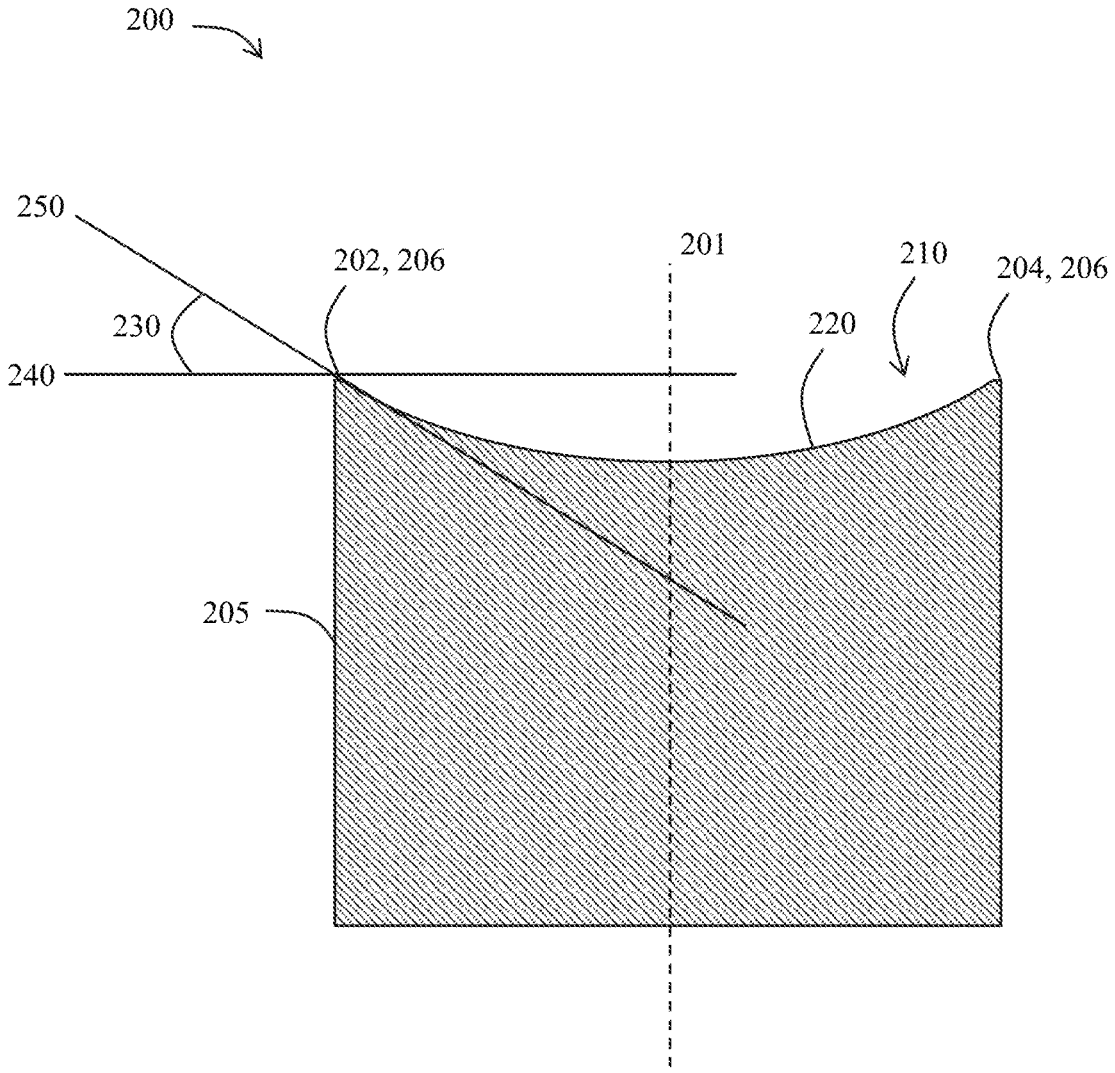
FIG. 5 shows a cross sectional view of a directional cutting element according to embodiments of the present disclosure.

For example, FIG. 5 is a cross-sectional view of a cutting element 200 according to embodiments of the present disclosure, showing a front rake angle 230 formed by a concave surface 220 portion of the cutting element's cutting face 210. The cross-sectional view is taken along a major axis of the concave surface 220, along which dimension the concave surface 220 extends between opposite sides 202, 204 of an edge 206 formed around the cutting element 200 at the intersection between the cutting face 210 and side surface 205 of the cutting element 200. A front rake angle 230 is measured between a radial plane 240 perpendicular to a longitudinal axis 201 of the cutting element 200 and a tangent line 250 to the concave surface 220 proximate to the edge 206 of the cutting element 200. The tangent line 250 extends tangent to the concave surface 220 from the border of the concave surface 220, where in the embodiment shown, the concave surface border intersects with the edge 206 at points 202, 204. In the embodiment shown, the front rake angle 230 formed along the major axis 226 by the concave surface 220 may range from about 5 degrees to about 45 degrees, or from about 5 degrees to about 25 degrees, e.g., a 10-degree front rake angle, a 20-degree front rake angle, or other value selected within such ranges. Further, the tangent line 250 intersects the longitudinal axis 201. In the embodiment shown, where the cross-section is taken along a major axis dimension of the concave surface 220, the tangent line 250 shown is also coplanar with the major axis dimension.

In embodiments having a face chamfer formed around the concave surface, such as shown in FIGS. 2-4, a tangent line 150 to the concave surface 123 proximate the edge 106 of the cutting element 100 may extend tangent to the concave surface 123, from the border 129 of the concave surface 123 to the longitudinal axis 101 (where the term proximate includes the distance between the edge 106 of the cutting element and the border 129 of the concave surface 123 created by the face chamfer 130).

The concave top surface 123 shown in the embodiment in FIGS. 2-4 may form a scoop shape, while the sloped surfaces 140 may have a generally conical shape. The scoop shape of the concave top surface 123 may provide the cutting element 100 with a positive front rake angle 250, which may increase cutting efficiency, while the conical transition from the sloped surfaces 140 may provide a crushing action around the edge 106 of the cutting element 100, which may reduce shear force and overall torque during cutting. Further, the concave top surface 123 having an elliptical shape may distribute stress more uniformly around the border 129 of the top surface 123, which may mitigate stress concentration during cutting and thereby improve durability of the cutting element 100.

Figure 6:
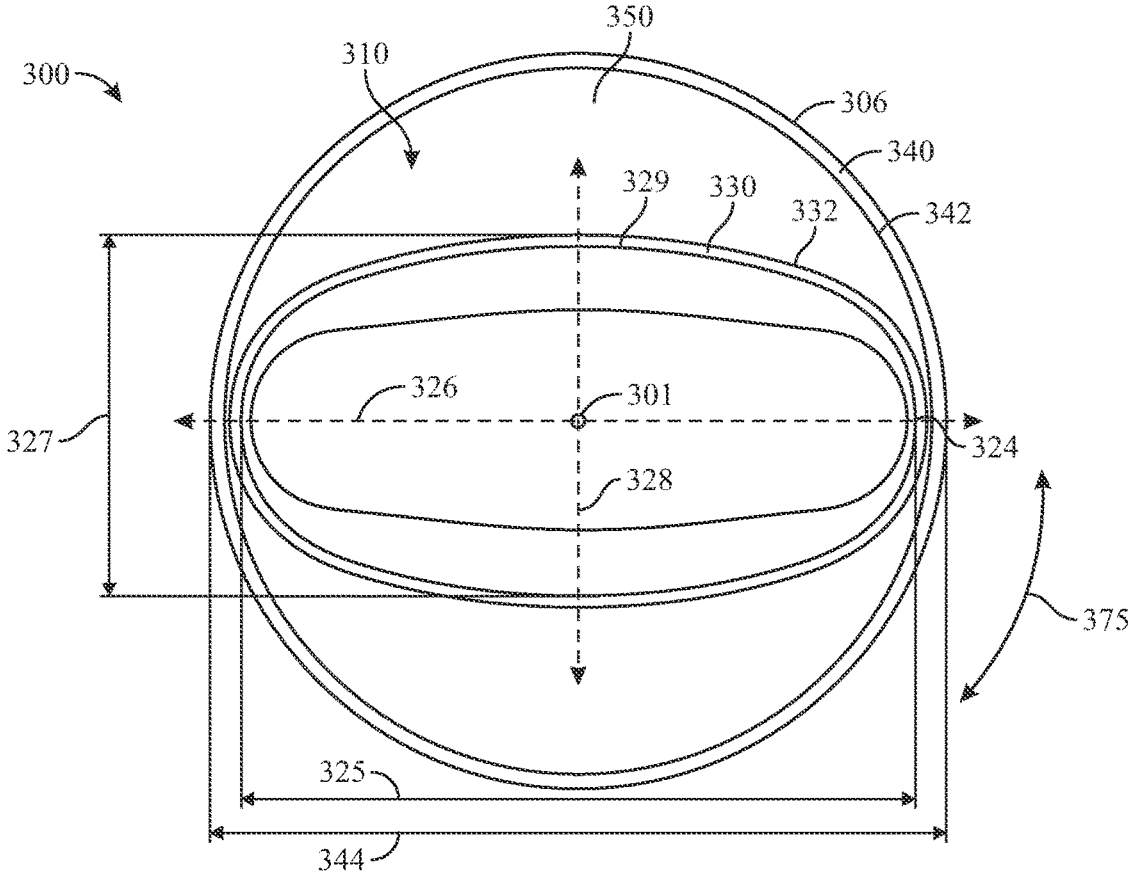
FIG. 6 shows a top view of a directional cutting element according to embodiments of the present disclosure.
Figure 7:
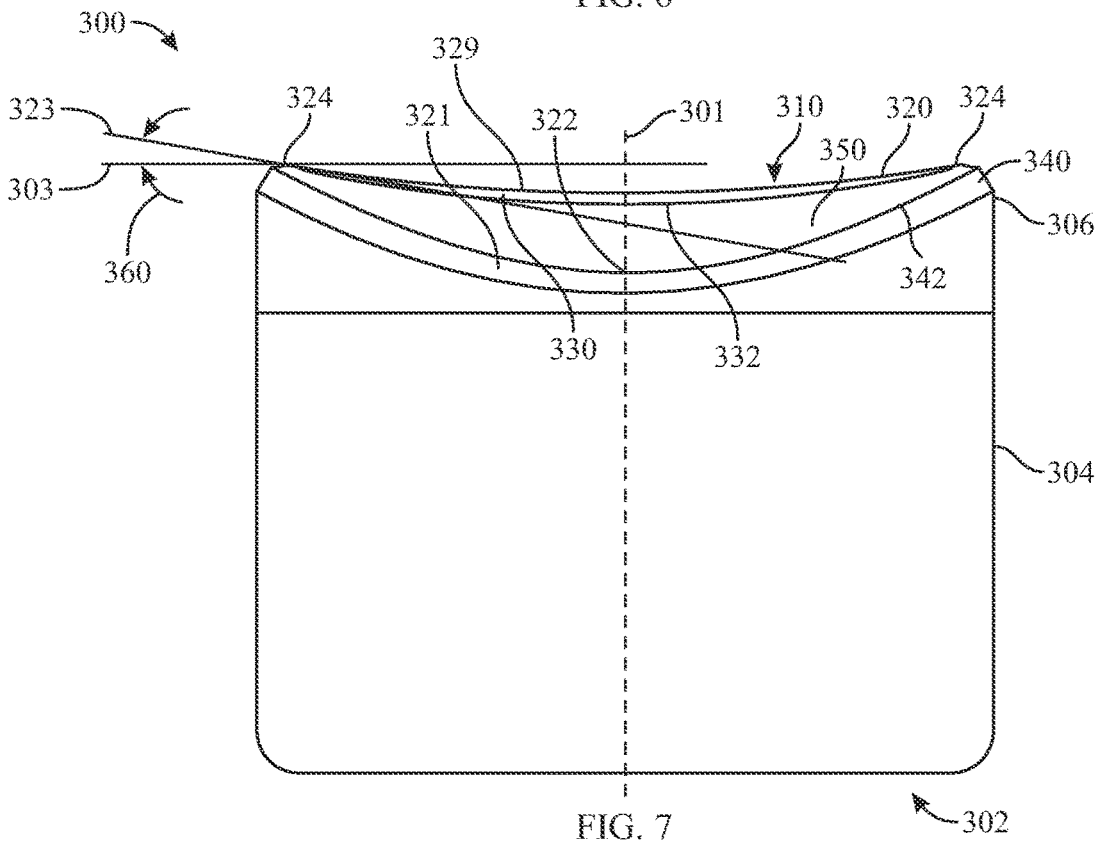
FIG. 7 shows a side view of the directional cutting element in FIG. 6.

FIGS. 6 and 7 show another example of a cutting element 300 according to embodiments of the present disclosure, where FIG. 6 is a top view, and FIG. 7 is a side view of the cutting element 300. The cutting element 300 has a cutting face 310 formed at an opposite axial end from a base 302 and a side surface 304 extending from the base 302 to the cutting face 310, where an edge 306 is formed at the intersection between the cutting face 310 and the side surface 304. A portion of the cutting face 310 is formed by a concave surface 320 defined by a border 329. The concave surface 320 extends a major axis dimension 325 between locations 324 proximate opposite sides of the edge 306 along a major axis 326, and extends a minor axis dimension 327 along a minor axis 328 perpendicular to the major axis 326, where the minor axis dimension 327 is less than the major axis dimension 325. For example, according to some embodiments of the present disclosure, the minor axis dimension 327 may range from between 50 percent to 99 percent of the major axis dimension 325. The major axis dimension 325 of the concave surface 320 is less than a width 344 (e.g., diameter) of the cutting element 300 between opposite edges 306 along the major axis 326. In some embodiments, the major axis dimension 325 may range from between 60 percent to 100 percent, from 70 percent to 100 percent, or from 80 to 95 percent of the width 344 of the cutting element 300. The minor axis dimension 327 may be greater than 20 percent of the width 344 of the cutting element 300. Embodiments of the cutting element 300 with the minor axis dimension 327 greater than 20 percent of the width 344 exhibit greater impact resistance than more narrow minor axis dimensions.

A face chamfer 330 is formed around the border 329 of the concave surface 320, where the border 329 is formed by the intersection of the concave surface 320 and the face chamfer 330. The border 329 formed at the transition between the concave surface 320 and the face chamfer 330 may be an angled or radiused point of inflection between the concave surface 320 and the face chamfer 330.

An edge chamfer 340 is formed interior to and around the entire edge 306 of the cutting element 300, where the intersection of the edge chamfer 340 and the side surface 304 form the edge 306. In some embodiments, a cutting face may have an edge chamfer formed partially around the edge (less than the entire edge) or may be without an edge chamfer around the edge. In some embodiments, the edge chamfer 340 may have a uniform size around the entire edge 306.

Sloped surfaces 350 extend between the face chamfer 330 and the edge chamfer 340 along a slope extending in a radially outward direction from a longitudinal axis 301 of the cutting element 300 and in an axially downward direction from the face chamfer 330 toward the base 302. The sloped surfaces 350 may intersect with the face chamfer 330 at an outer perimeter 332 of the face chamfer 330 and may intersect with the edge chamfer 340 at an inner perimeter 342 of the edge chamfer 340. Further, the sloped surfaces 350 may intersect with the face chamfer 330 and/or edge chamfer 340 at angled or radiused transitions. Although the face chamfer 330 and edge chamfer 340 may also slope in the same general direction as the sloped surfaces 350, the sloped surfaces 350 may have a different slope value than each of the face chamfer 330 and edge chamfer 340. For example, the sloped surfaces 350 may have a relatively steeper slope than the face chamfer 330 and a relatively shallower slope than the edge chamfer 340, when the slopes are drawn along a coordinate system with the longitudinal axis 301 as the y-axis and a radial plane 303 (perpendicular to the longitudinal axis 301) as the x-axis.

A front rake angle 360 is measured between the radial plane 303 and a tangent line 323 to the concave surface 320 proximate to the edge 306 of the cutting element 300. The tangent line 323 extends tangent to the concave surface 320 from the location 324 along the border 329 of the concave surface 320 that is proximate to but separated from the edge 306 by the face chamfer 330 and the edge chamfer 340. Further, the tangent line 323 intersects the longitudinal axis 301 and is coplanar with the major axis 326. In the embodiment shown, the front rake angle 360 formed along the major axis 326 by the concave surface 320 may range from about 5 degrees to about 25 degrees, e.g., a 10-degree front rake angle, a 20-degree front rake angle, or other value selected within such range.

The cutting element 300 shown in FIGS. 6 and 7 is directional in that the front rake angle 360 formed by the geometry of the cutting face 310 varies around the perimeter of the cutting face 310. For example, the front rake angle 360 formed around the cutting face 310 perimeter at the major axis 326 of the concave surface 320 is positive. Thus, when the cutting element 300 is rotationally oriented on a tool to contact the location 324 around the edge 306 of the cutting element intersecting the major axis 326 to a working surface (e.g., a formation), the cutting element 300 may contact the working surface at a positive front rake angle 360. However, the front rake angle 360 formed around the cutting face 310 perimeter at locations 321, 322 around the edge 306 where the sloped surfaces 350 intersect the edge chamfer 340 (e.g., at locations 322 around the edge 306 of the cutting element intersecting the minor axis 328) may be negative. Thus, if the cutting element 300 is rotated 375 (either clockwise or counterclockwise) about its longitudinal axis 301 to a rotational orientation where locations 322 around the edge 306 of the cutting element intersecting the minor axis 328 contact and cut a working surface, the cutting element 300 may contact the working surface at a negative front rake angle 360. In this manner, the cutting element 300 shown in FIGS. 6 and 7 is directional, and its performance in cutting a working surface depends on its rotational orientation on a tool, and thus which front rake angle will contact the working surface.

As used herein, terms referring to the rotational orientation of a cutting element 300 may be used to describe how the cutting element 300 is set on a tool rotationally about its longitudinal axis 301. For example, a cutting element 300 may be positioned on a tool at a base rotational orientation, and may optionally be attached at the base rotational orientation such as by brazing and/or mechanical attachment, or the cutting element 300 may be rotated around its longitudinal axis 301 to a subsequent rotational orientation and attached to the tool at the subsequent rotational orientation.

Figure 8:
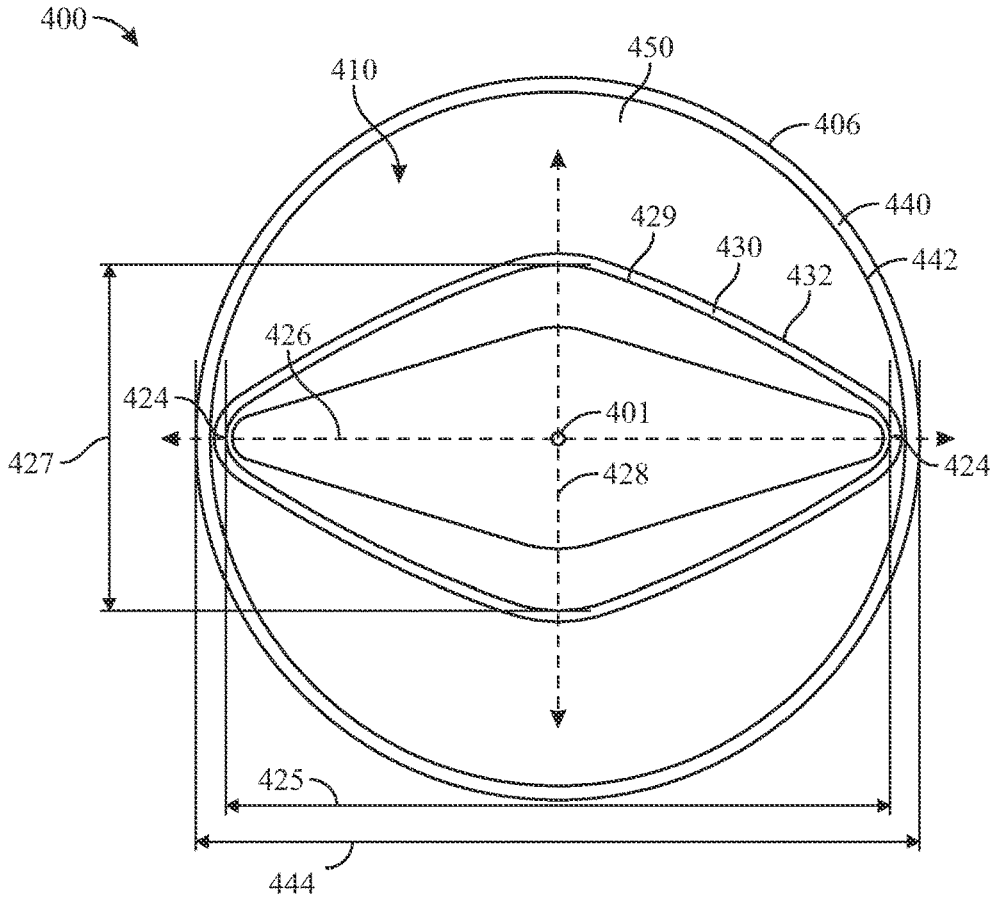
FIG. 8 shows a top view of a directional cutting element according to embodiments of the present disclosure.
Figure 9:
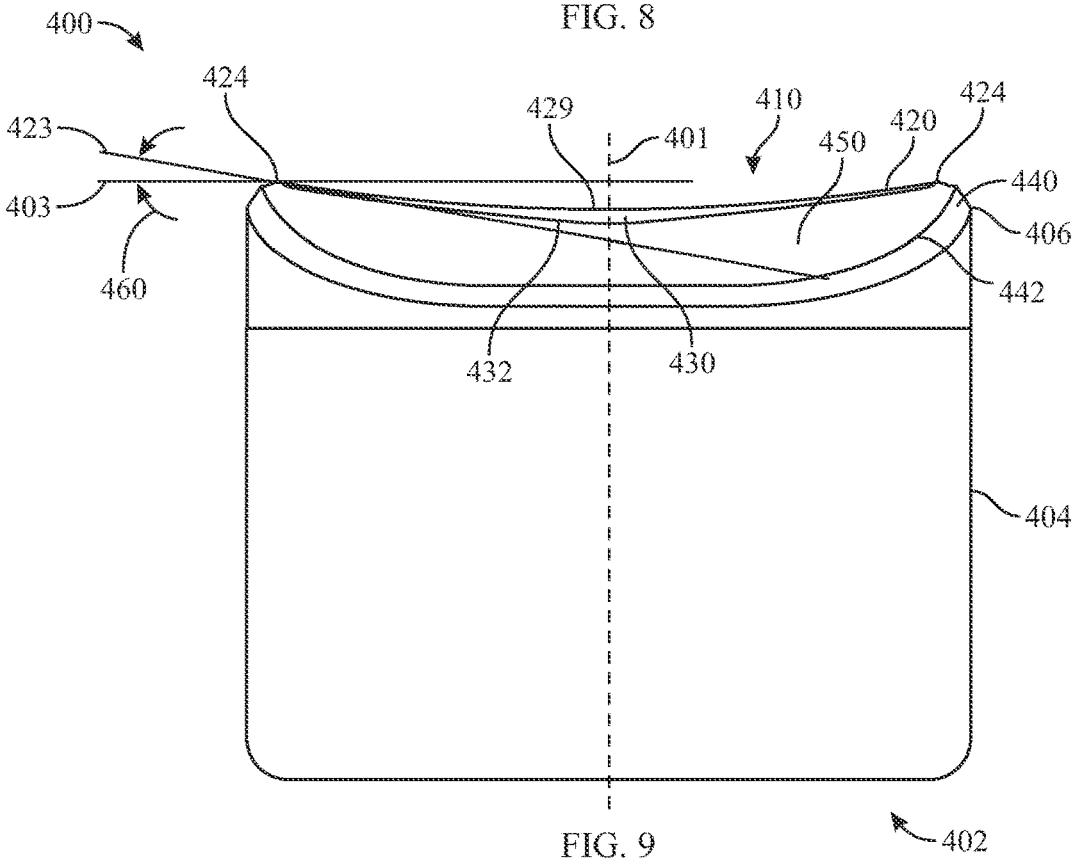
FIG. 9 shows a side view of the directional cutting element in FIG. 8.

Another example of a directional cutting element 400 according to embodiments of the present disclosure is shown in FIGS. 8 and 9, where FIG. 8 is a top view, and FIG. 9 is a side view of the cutting element 400. The cutting element 400 has a cutting face 410 formed at an opposite axial end from a base 402 and a side surface 404 extending from the base 402 to the cutting face 410, where an edge 406 is formed at the intersection between the cutting face 410 and the side surface 404. A portion of the cutting face 410 is formed by a concave surface 420, where a border 429 extends around the concave surface 420 and defines a diamond-shaped concave surface 420. The diamond-shaped concave surface 420 extends a major axis dimension 425 between locations 424 proximate opposite sides of the edge 406 along a major axis 426, and extends a minor axis dimension 427 along a minor axis 428 perpendicular to the major axis 426, where the minor axis dimension 427 is less than the major axis dimension 425. According to embodiments of the present disclosure, the major axis 426 may be drawn along the longest dimension of the concave surface 420, intersecting locations 424 along the border 429 located the greatest distance apart from each other relative to any other locations along the border 429. The minor axis 428 may be drawn perpendicular to the major axis 426 at the widest part of the concave surface 420 along the major axis 426. The major axis dimension 425 of the concave surface 420 is less than a width 444 (e.g., diameter) of the cutting element 400 between opposite edges 406 along the major axis 426. In some embodiments, the major axis dimension 425 may range from between 60 percent to 100 percent, from 70 percent to 100 percent, or from 80 to 95 percent of the width 444 of the cutting element 400. The minor axis dimension 427 may be greater than 20 percent of the width 444 of the cutting element 400. Embodiments of the cutting element 400 with the minor axis dimension 427 greater than 20 percent of the width 444 exhibit greater impact resistance than more narrow minor axis dimensions.

In addition to the concave surface 420, the cutting face 410 may also include a face chamfer 430 formed around the border 429 of the concave surface 420, an edge chamfer 440 formed interior to and around the entire edge 406 of the cutting element 400, and sloped surfaces 450 sloping from an outer perimeter 432 of the face chamfer 430 in a downward axial direction (toward the base 402) and a radially outward direction (toward the side surface 404) to an inner perimeter 442 of the edge chamfer 440. The sloped surfaces 450 may intersect with the outer perimeter 432 of the face chamfer 430 and the inner perimeter 442 of the edge chamfer 440 at angled or radiused transitions. Further, the face chamfer 430, edge chamfer 440, and sloped surfaces 450 may slope in the same general direction but have different slope values. For example, the sloped surfaces 450 may have a relatively steeper slope than the face chamfer 430 and a relatively shallower slope than the edge chamfer 440, when the slopes are drawn along a coordinate system with the longitudinal axis 401 as the y-axis and a radial plane 403 (perpendicular to the longitudinal axis 401) as the x-axis.

A front rake angle 460 is measured between the radial plane 403 and a tangent line 423 to the concave surface 420 proximate to the edge 406 of the cutting element 400, where the tangent line 423 intersects the longitudinal axis 401. When oriented to contact a working surface along the major axis 426, the contacting front rake angle 460 may be defined by the tangent line 423 extending tangent to the concave surface 420 from the location 424 at the border 429 and along the major axis 426 that is proximate to but separated from the edge 406 by the face chamfer 430 and the edge chamfer 440. At location 424, the face chamfer 430 may intersect with the edge chamfer 440. In the embodiment shown, the front rake angle 460 formed along the major axis 426 by the concave surface 420 may range from about 5 degrees to about 25 degrees, e.g., a 10-degree front rake angle, a 20-degree front rake angle, or other value selected within such range.

According to embodiments of the present disclosure, directional cutting elements (e.g., directional cutting elements 200, 300, 400 shown in FIGS. 2-9) may be positioned on a downhole tool at a rotational orientation designed to contact a working surface at an alignment with a major axis of an elongated protrusion on the cutting element, where the alignment may be referred to in context with a rolling rake angle (e.g., an adjusted profile angle). As described in more detail below, a rolling rake angle may be defined by the rotational angle of a directional cutting element between the cutting element's base rotational orientation on a downhole tool and an aligned rotational orientation on the downhole tool.

Figure 1:
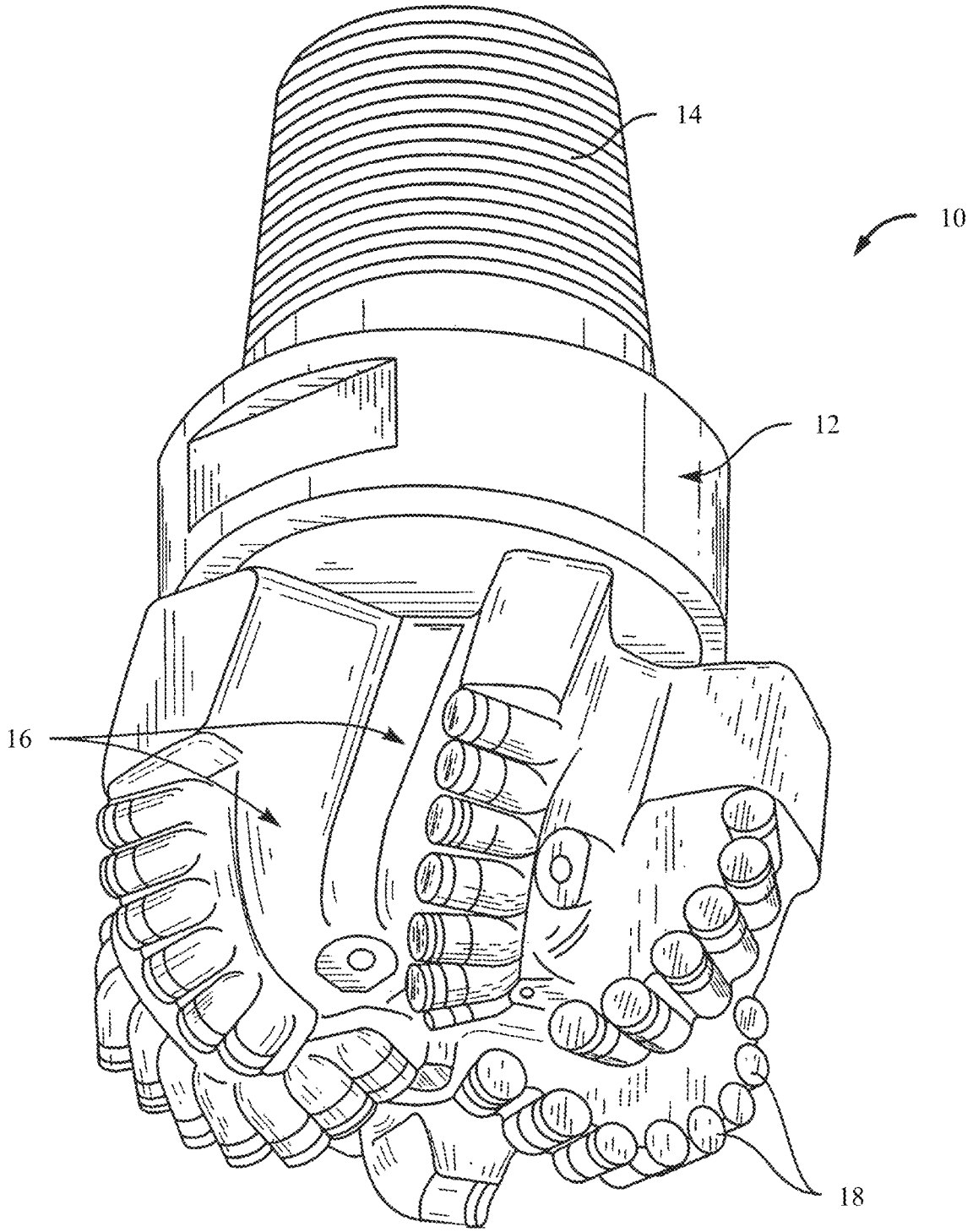
FIG. 1 (Prior Art)
FIG. 1 shows a conventional drill bit.
Figure 10:
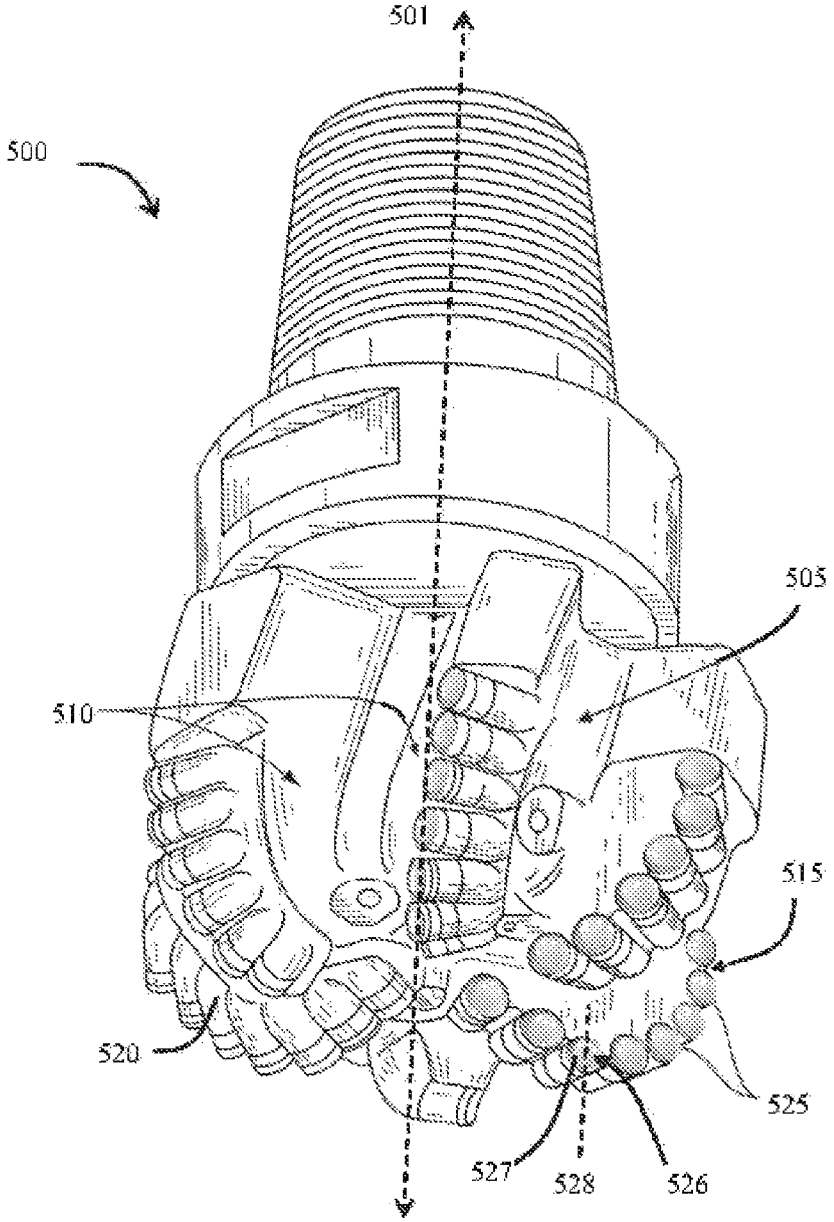
FIG. 10 shows a downhole tool having directional cutting elements thereon according to embodiments of the present disclosure.
Figure 11:
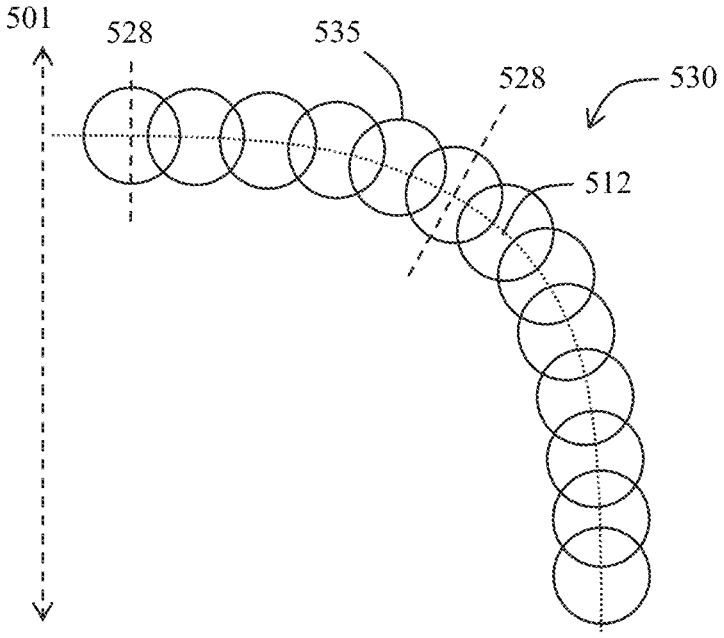
FIG. 11 shows a cutting profile of the downhole tool in FIG. 10.

Initially, when designing a downhole tool, such as a fixed cutter drill bit (e.g., shown in FIG. 1), a cutting profile of the downhole tool may be prepared, as shown by the simplified representation of steps for preparing a cutting profile in FIGS. 10 and 11. A downhole tool 500 may include any downhole cutting tool known in the art, for example, drill bits and reamers, having a plurality of blades 510 extending outwardly from a body 505 and a plurality of cutting elements 520 disposed in pockets formed along a blade cutting edge 515 of each of the blades 510, as shown in FIG. 10. The downhole tool 500 may rotate about a rotational axis 501 extending axially through the tool 500. According to embodiments of the present disclosure, the downhole tool 500 may have at least one directional cutting element 525 positioned along a blade 510. For example, a downhole tool 500 may include one or more directional cutting elements 525 and one or more non-directional cutting elements, or the downhole tool 500 may have directional cutting elements 525 used for all its cutting elements 520. Directional cutting elements 525 may include cutting faces 526 having an elongated protrusion 527 extending along a major axis 528, e.g., directional cutting elements shown in FIGS. 2-9, or may include other cutting face geometries having one or more protrusions spaced azimuthally around the edge of the cutting face. Non-directional cutting elements may include cutting elements having a uniform cutting face geometry around the edge of the cutting face, such as conventional cutters having a planar cutting face, round top, or conical cutting face.

As shown in FIG. 11, the cutting profile 530 of the downhole tool 500 may include an outline 535 of the cutting elements 520 when rotated into a single plane view. According to embodiments of the present disclosure, the cutting profile 530 may be prepared by simulating the downhole tool 500, including the directional cutting elements 525 positioned thereon, and simulating the rotation of the downhole tool 500 about its rotational axis 501 into the single plane view, as shown in FIG. 11. In the cutting profile 530 shown, the cutting elements 520 are shown along a blade profile 512 of the downhole tool 500, where a blade profile 512 is a two-dimensional outline of a blade 510 on the downhole tool 500.

Methods of the present disclosure may include determining a base rotational orientation of a directional cutting element 525 on a downhole tool 500. For example, an initial downhole tool design may include one or more directional cutting elements 525 rotationally oriented on a blade 510 in a base rotational orientation, such that the major axis 528 of a protruded feature formed on the cutting face 526 of the cutting element 525 is orthogonal to the blade profile 512. The directional cutting element 525 may then be rotated about its longitudinal axis an adjusted profile angle to an aligned rotational orientation on the downhole tool 500, either in the design stage (where the cutting element rotation may be simulated) or on a real/physical downhole tool. Rotational changes of one or more directional cutting elements 525 on a downhole tool 500 may be simulated, for example, in the same simulation used for generating the cutting profile 530. According to embodiments of the present disclosure, a directional cutting element 525 may be rotated an adjusted profile angle ranging from about 3 degrees to about 30 degrees from a base rotational orientation.

Figure 12:
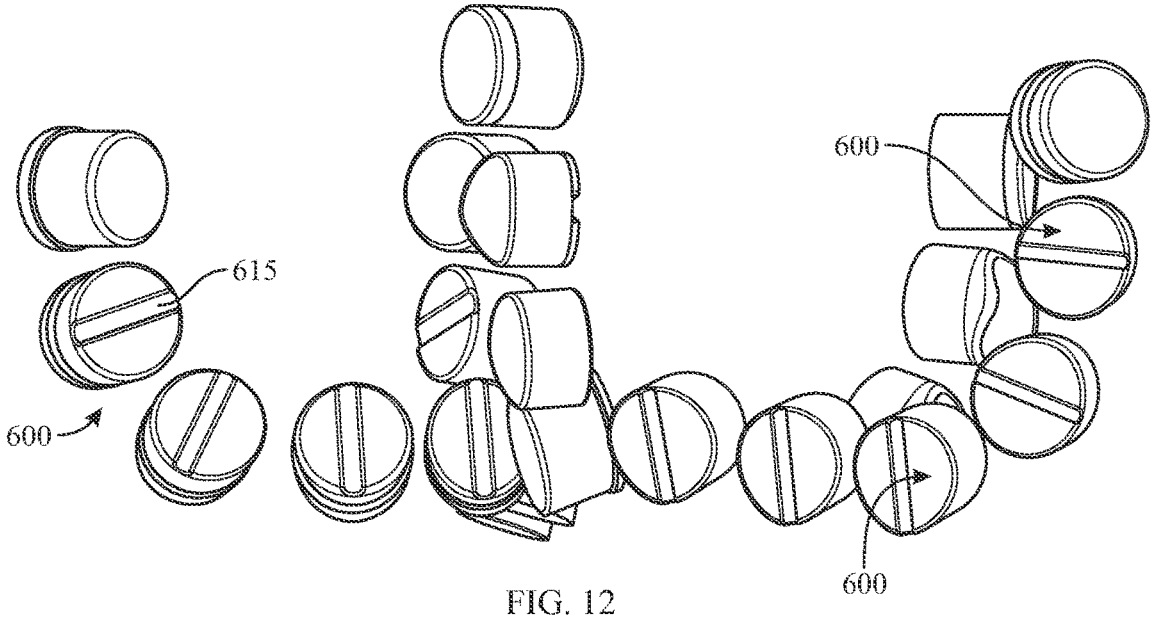
FIG. 12 shows directional cutting elements as they are arranged on a downhole tool.
Figure 13:
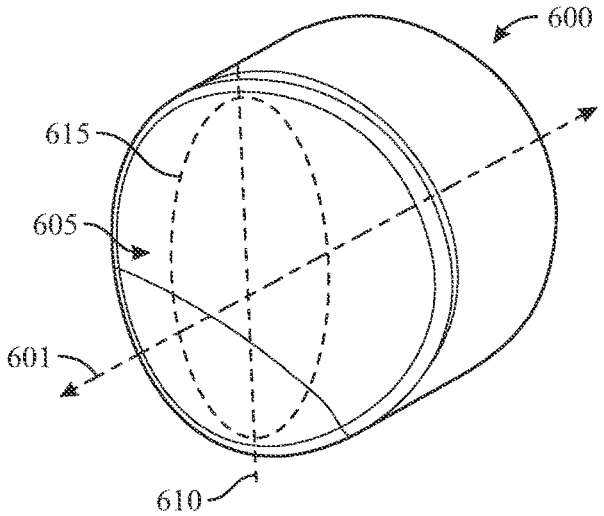
FIG. 13 shows a directional cutting element according to embodiments of the present disclosure in a base rotational orientation.

FIGS. 12-15 show an example of a method for rotating a directional cutting element 600 an adjusted profile angle 670 according to embodiments of the present disclosure. In FIG. 12, a simulation of directional cutting elements 600 is shown, configured as they would be positioned along blades of a downhole tool (where for simplicity the downhole tool is omitted from the simulation rendering). In the base configuration of the directional cutting elements 600, one or more (e.g., all) of the directional cutting elements 600 may be simulated in a base rotational orientation, shown in FIG.

Figure 14:
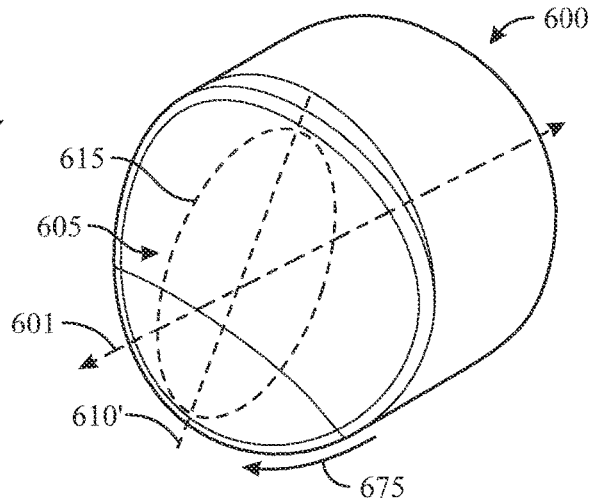
FIG. 14 shows the directional cutting element in FIG. 13 in an aligned rotational orientation.
Figure 15:
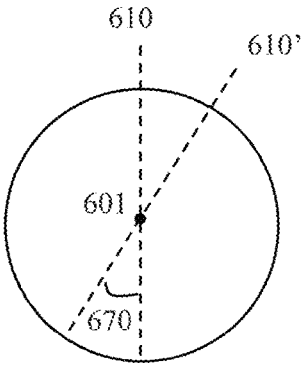
FIG. 15 shows a rolling rake angle for the directional cutting element in FIGS. 13 and 14.

13, where a major axis 610 of a protruded feature 615 formed on the cutting face 605 of the directional cutting element 600 is oriented orthogonally to a blade profile of a blade on which the directional cutting element 600 would be disposed. As shown in FIG. 14, a simulation of the directional cutting element 600 rotated 675 about its longitudinal axis 601 may be generated, to where the major axis 610' is in an aligned rotational orientation. The rotational difference between the major axis 610 in the base rotational orientation and the major axis 610' in the aligned rotational orientation may be referred to as the adjusted profile angle 670, as shown in the schematic of FIG. 15.

Figure 16:
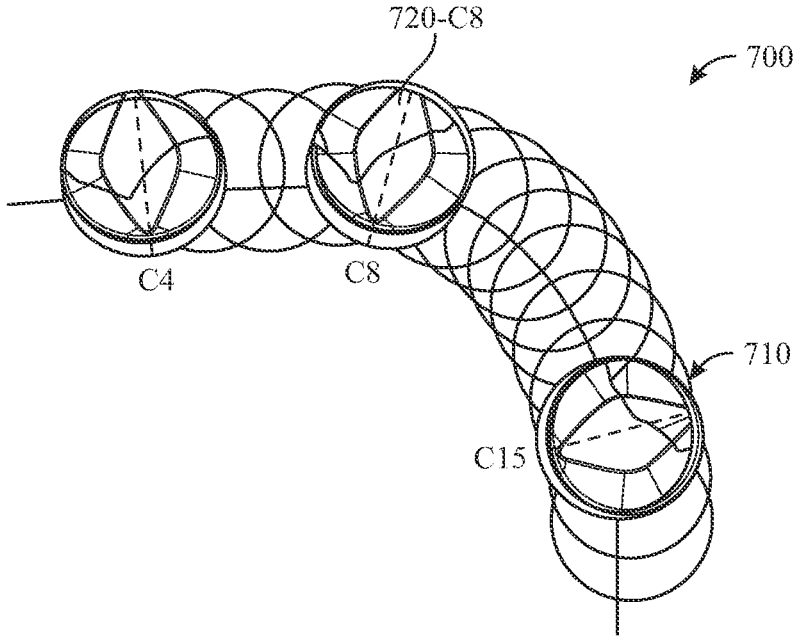
FIG. 16 shows a cutting profile according to embodiments of the present disclosure.
Figure 17:
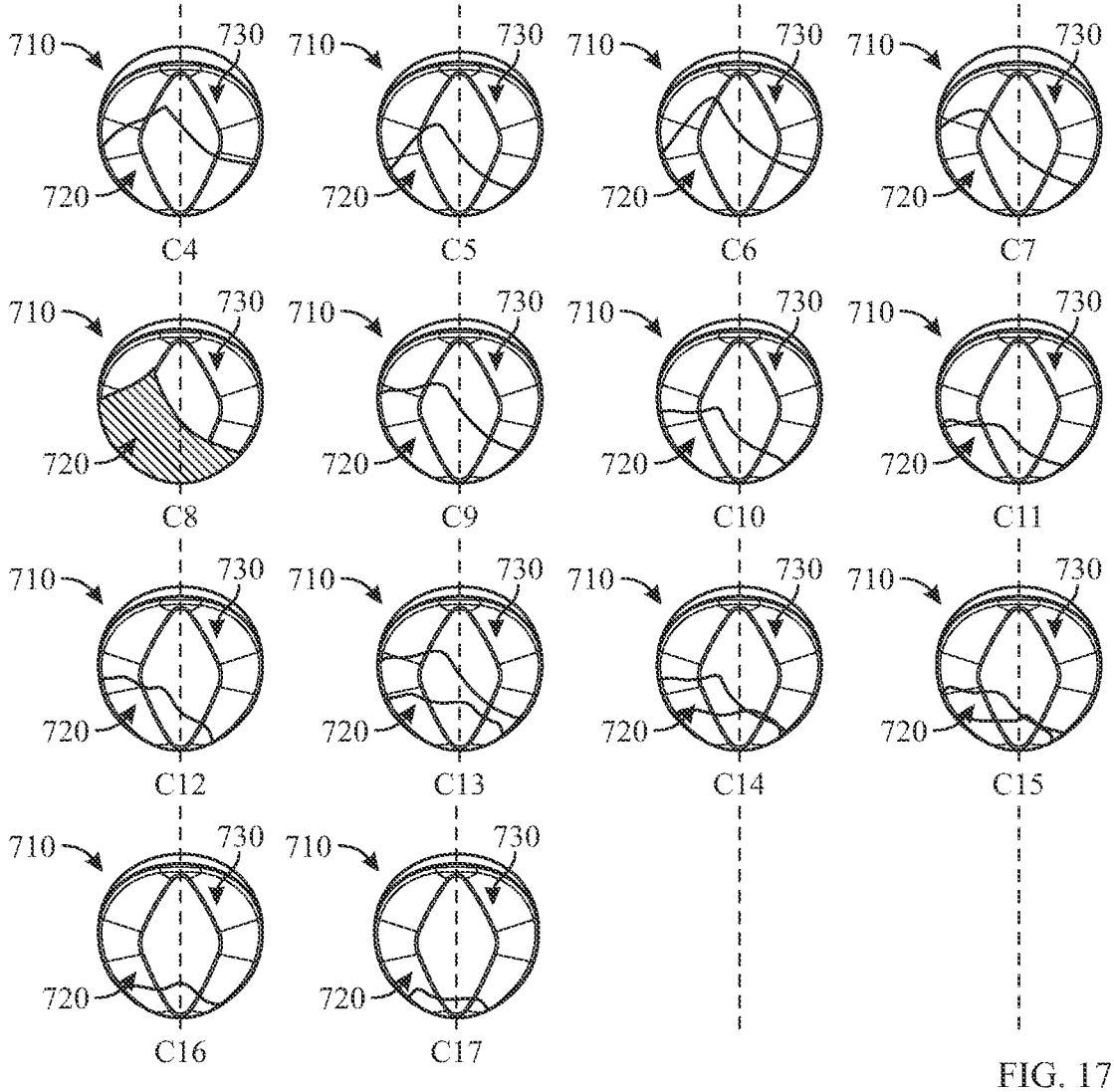
FIG. 17 shows exposed areas of the directional cutting elements from the cutting profile in FIG. 16 according to embodiments of the preset disclosure.

According to embodiments of the present disclosure, an adjusted profile rolling rake angle 670 may be selected based on an exposed area of a cutting element's cutting face 526 along a cutting profile 530 of the downhole tool 500 on which the cutting element 525 is disposed. As discussed herein, the term "geometry of cut" may be used to describe the exposed area of the cutting face 526 of a cutting element that encounters the formation based on the arrangement of other cutting elements along a cutting profile 700. For example, FIGS. 16 and 17 show an example of determining an exposed area (e.g., a geometry of cut) 720 on a cutting face 730 of a directional cutting element 710 based on the position of the other cutting elements along a cutting profile 700. FIG. 16 shows an example of a cutting profile 700 of directional cutting elements 710 disposed along a downhole tool. At each position (C4, C5 . . . C16, C17) along the cutting profile 700, the directional cutting elements 710 have an exposed area 720 that is not overlapped by adjacent cutting elements on the cutting profile 700. FIG. 17 shows the exposed areas 720 on the cutting faces 730 of each of the directional cutting elements 710 along the cutting profile 700. As shown, the exposed areas 720 may be different for directional cutting elements 710 at different positions (C4-C17) along the cutting profile 700. For example, the exposed area 720-C8 on the directional cutting element 710 in the C8 position in the cutting profile 700 is shown on both the cutting profile 700 in FIG. 16 and on the individual directional cutting element 710-C8 in FIG. 17, where the exposed area (e.g., geometry of cut) 720-C8 corresponds to the surface area on the cutting face 730 that is exposed on the cutting profile 700.

Figure 18:
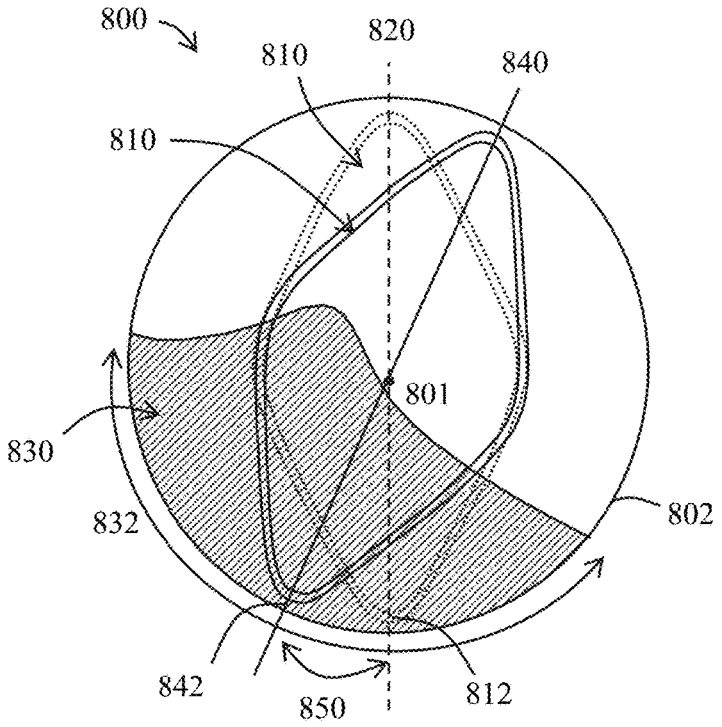
FIG. 18 shows a top view of a directional cutting element according to embodiments of the present disclosure.

In methods of the present disclosure, an exposed area on a cutting face of a directional cutting element in a cutting profile may be determined, and the exposed area may be used to define a rolling rake axis extending radially outward from a longitudinal axis of the directional cutting element and through a middle of the exposed area (e.g., geometry of cut). For example, FIG. 18 shows a diagram of a cutting face 800 of a directional cutting element (e.g., such as shown in FIGS. 8 and 9) in a base rotational orientation (shown in phantom lines) and rotated in an aligned rotational orientation. As shown in the base rotational orientation, the cutting face geometry includes an elongated protrusion 810 having a major axis 820 drawn through a longitudinal axis 801 of the cutting element and a location 812 around the elongated protrusion 810 that is proximate to the edge 802 of the cutting face 800, as if the cutting element were arranged on a cutting tool with the major axis 820 of the elongated protrusion 810 orthogonal to a profile of the cutting tool on which the cutting element is attached (e.g., a blade profile 512 as shown in FIG. 11).

Further, by simulating the cutting element in a cutting profile (e.g., such as a cutting profile 700 shown in FIG. 16), an exposed area 830 of the cutting face 800 may be determined as the area of the cutting face 800 that is not overlapping with adjacent cutting elements on the cutting profile. In some embodiments, a rolling rake axis 840 may be drawn radially outward from the longitudinal axis 801 of the cutting element and through a middle 842 of the exposed area 830. In the embodiment shown, the middle 842 of the exposed area 830 may be a midpoint along a partial arc length 832 of the edge 802 of the cutting face 800 in the exposed area 830. Thus, the rolling rake axis 840 extends through the longitudinal axis 801 of the cutting element and the midpoint 842 of the partial arc length 832 of the exposed area 830. A rolling rake angle 850 may be defined between the major axis 820 of the elongated protrusion 810 in the base rotational orientation and the rolling rake axis 840. In the aligned rotational orientation, the cutting element is rotated such that the major axis 820 of the protrusion 810 is coaxial with the rolling rake axis 840.

Figure 19:
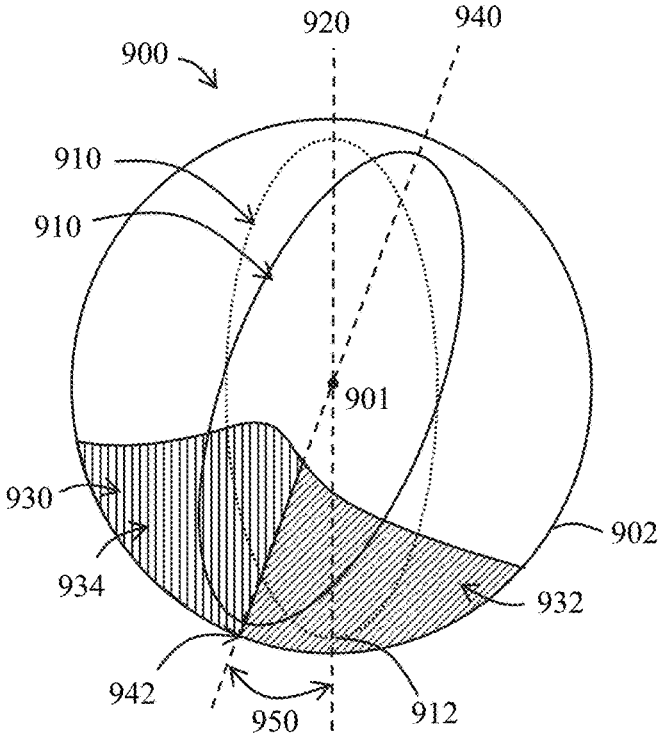
FIG. 19 shows a top view of a directional cutting element according to embodiments of the present disclosure.

In some embodiments, the middle of an exposed area (and thus rolling rake axis) may be defined by dividing the exposed area into axi-equivalent halves. For example, FIG. 19 shows another example of a cutting face 900 of a directional cutting element in a base rotational orientation (shown in phantom lines) and an aligned rotational orientation. As shown in the base rotational orientation, the cutting face geometry includes at least one protrusion 910 spaced azimuthally around an edge 902 of the cutting face 900, where a major axis 920 of the protrusion 910 is drawn through the longitudinal axis 901 of the cutting element and a location 912 around the protrusion 910 that is closest to the edge 902 of the cutting face 900. In the base rotational orientation, the orientation of the protrusion 910 (and cutting face 900) is as if the cutting element were arranged on a cutting tool with the major axis 920 of the protrusion 910 orthogonal to a profile of the cutting tool. The cutting element may be simulated in a cutting profile (e.g., such as cutting profile 700 shown in FIG. 16) to generate a predicted exposed area (e.g., geometry of cut) 930 on the cutting face 900 that does not overlap with adjacent cutting elements on the cutting profile. In some embodiments, a rolling rake axis 940 may be drawn radially outward from the longitudinal axis 901 of the cutting element and through a middle 942 of the exposed area 930. In the embodiment shown, the middle 942 of the exposed area 930 may be a radial line that divides the exposed area 930 into axi-equivalent halves 932, 934 with respect to the rolling rake axis 940, where the axi-equivalent halves 932, 934 have equal areas. A rolling rake angle 950 may be defined between the major axis 920 of the protrusion 910 in the base rotational orientation and the rolling rake axis 940. In the aligned rotational orientation, the cutting element is rotated such that the major axis 920 of the protrusion 910 is coaxial with the rolling rake axis 940.

In some embodiments, a rolling rake axis may be defined using a force balancing equation, where radial forces on the cutting element from the clockwise and counterclockwise direction are balanced when the cutting element interfaces with the formation. Because radial forces acting on a cutting element may vary at different depths of cut, a rolling rake axis may be defined using a force balancing equation at one or more given depths of cut. For example, a first directional cutting element at a first position along a downhole cutting tool may be predicted to interface with a formation at a first depth of cut, while a second directional cutting element at a different, second position along the downhole cutting tool may be predicted to interface with the formation at a different, second depth of cut. In such case, a rolling rake axes for the first and second directional cutting elements may be determined using force balancing equations at different depths of cut.

As another example, a directional cutting element at a position along a downhole cutting tool may be predicted to interface with a formation at a first depth of cut while the downhole tool is in operation under a first set of conditions (e.g., rotational speed, weight on bit, type of formation being drilled, etc.), and the directional cutting element may be predicted to interface with the formation at a different, second depth of cut while the downhole tool is in operation under a different, second set of conditions. In some embodiments, a force balance equation at each of the first and second depths of cut may be used to determine a rolling rake axis for each depth of cut. Further, in some embodiments, a directional cutting element may be in an aligned rotational orientation with a rolling rake axis determined for a first set of conditions at a first depth of cut, and the directional cutting element may be rotated and reoriented in an aligned rotational orientation with a rolling rake axis determined for a different, second set of conditions at a second depth of cut.

Figure 34:
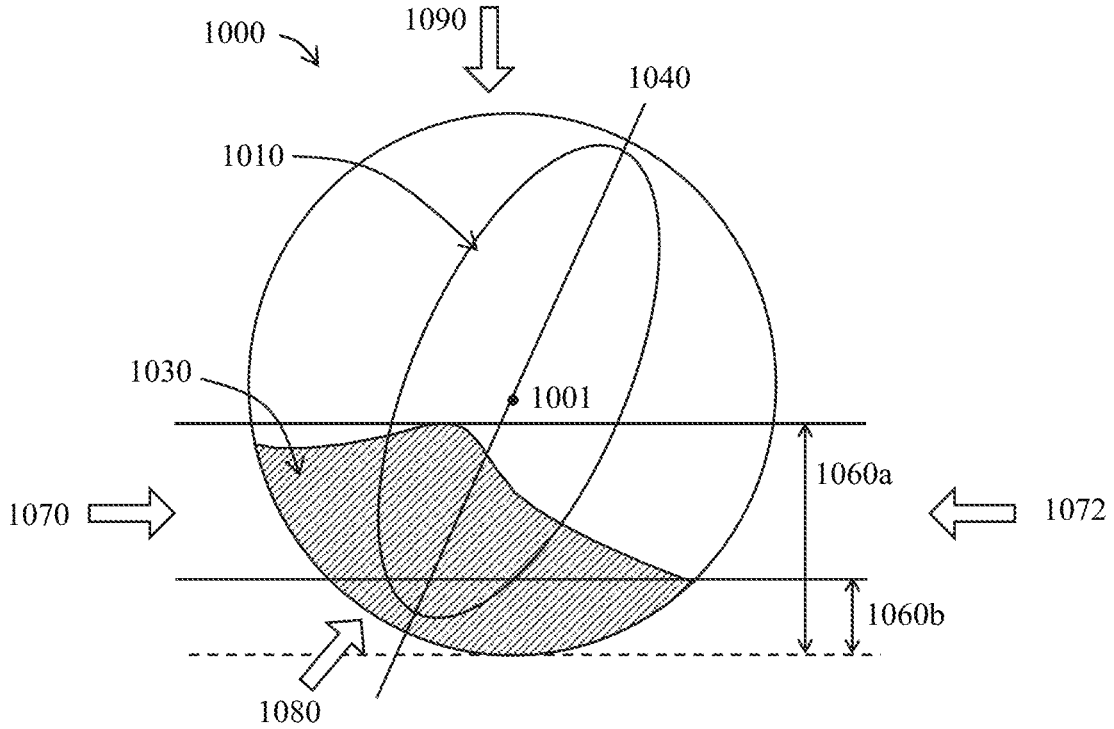
FIG. 34 shows a top view of a directional cutting element at a first depth of cut according to embodiments of the preset disclosure.
Figure 35:
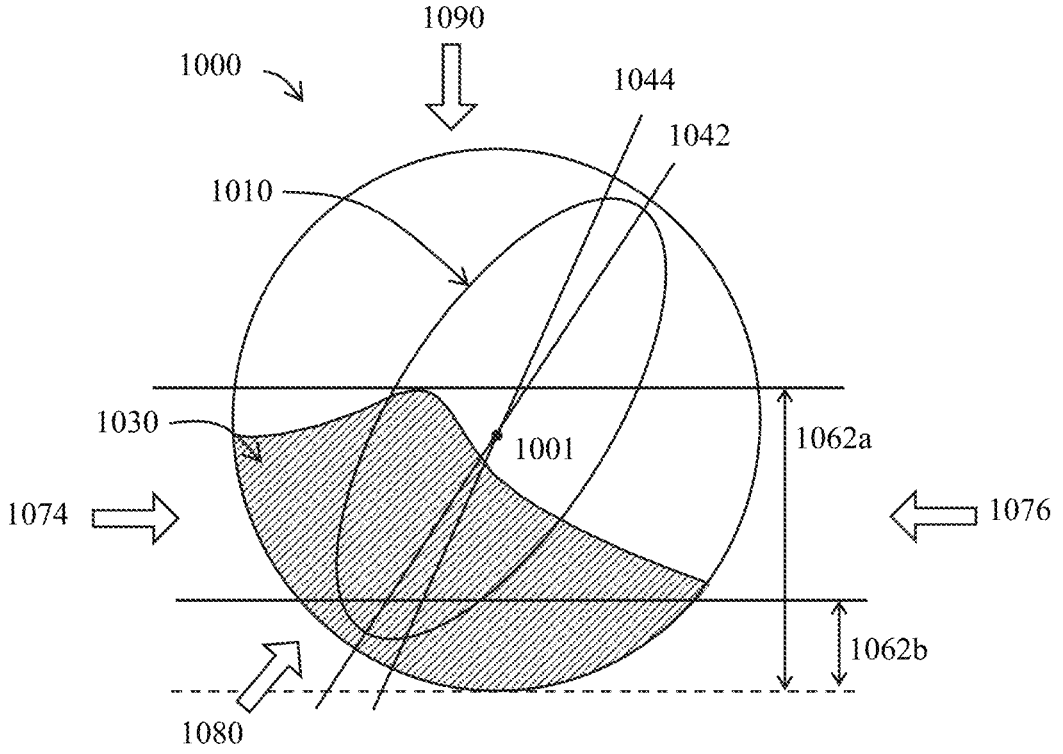
FIG. 35 shows a top view of the directional cutting element in FIG. 34 at a different depth of cut according to embodiments of the present disclosure.

FIGS. 34 and 35 show examples of a directional cutting element 1000 at an aligned rotational orientation with a rolling rake axis 1040, 1042 at different depths of cut 1060, 1062. The depth of cut 1060, 1062 may refer to a thickness of rock being removed by a cutting element 1000 during operation of the cutting element 1000 (e.g., as a bit rotates, the thickness of rock removed by a cutting element on the bit from a single rotation of the bit). The depth of cut 1060, 1062 may vary across the cutting element 1000 depending on the geometry of cut. For example, in FIG. 34, the cutting element 1000 is rotationally oriented and positioned in a cutting profile to have an exposed area 1030 that may contact a formation a varying depth of cut 1060 ranging from a maximum depth of cut 1060*a* to a minimum depth of cut 1060*b* (where the maximum depth of cut 1060*a*, minimum depth of cut 1060*b* and values in between may collectively be referred to as the depth of cut 1060). The asymmetric three-dimensional shape of the geometry of cut and varying depth of cut 1060 may cause forces from different directions to act on the directional cutting element 1000 (and its cutting face) during operation, which may affect the cutting element's performance. In FIG. 35, the cutting element 1000 is rotationally oriented and positioned in a cutting profile to have an exposed area 1030 that may contact a formation a different varying depth of cut 1062 ranging from a maximum depth of cut 1062*a* to a minimum depth of cut 1062*b* (where the maximum depth of cut 1062*a*, minimum depth of cut 1062*b* and values in between may collectively be referred to as the depth of cut 1062). The change in rotational orientation of the cutting element 1000, and thus change in three-dimensional shape of the geometry of cut and varying depth of cut 1062, may result in different forces acting on the directional cutting element 1000 during operation. In such manner, rotation of the directional cutting element 1000 may alter its performance.

According to embodiments of the present disclosure, the rolling rake axis 1040, 1042 of a directional cutting element 1000 may be rotated to an aligned rotational orientation where one or more types of forces acting on the directional cutting element 1000 are minimized. For example, the rolling rake axes 1040, 1042 may be determined at least in part from simulated and/or calculated radial forces 1070, 1072, 1074, 1076 on the cutting element 1000. As shown in FIG. 34, when the cutting element 1000 is at a first depth of cut 1060, outward radial forces 1070 (in a direction from a rotational axis (e.g., 501 in FIG. 10) of a cutting tool (e.g., 500 in FIG. 10) on which the cutting element 1000 is disposed toward an outer diameter of the cutting tool) and inward radial forces 1072 (in a direction from the outer diameter of the cutting tool toward the rotational axis of the cutting tool on which the cutting element is disposed) may act on the protrusion 1010 formed on the cutting face of the cutting element 1000. From simulations and/or calculations of the outward and inward radial forces 1070, 1072, the rolling rake axis 1040 may be defined along a radial line where the outward and inward radial forces 1070, 1072 are balanced on either side of the radial line (e.g., the outward radial force 1070 is closer in value to the inward radial force 1072 than prior to balancing).

As shown in FIG. 35, when the cutting element 1000 is at a second depth of cut 1062 greater than the first depth of cut 1060, outward and inward radial forces 1074, 1076 may act on a larger portion of the protrusion 1010, and thus may have a different affect on the cutting element 1000 than when at the first depth of cut 1060. A second rolling rake axis 1042 may be determined based on the outward and inward radial forces 1074, 1076 acting on the cutting element 1000 at the second depth of cut 1062, where the second rolling rake axis 1042 is a radial line with balanced radial forces 1074, 1076 across the radial line (e.g., the outward radial force 1074 is closer in value to the inward radial force 1076 than prior to balancing).

When defining a rolling rake axis 1040, 1042, the outward and inward radial forces 1070, 1072, 1074, 1076 may be calculated by determining an exposed area 1030 (e.g., geometry of cut) on the cutting face of the cutting element 1000 and determining the radial forces 1070, 1072, 1074, 1076 acting on the exposed area 1030. The rolling rake axes 1040, 1042 may be defined as the radial line from the longitudinal axis 1001 of the cutting element through the exposed area 1030 having balanced radial forces across the radial line. In some embodiments, additional forces may be included in a force balancing equation (e.g., cutting forces 1080 (which may sometimes be referred to as tangential force) and/or vertical forces 1090) to determine a rolling rake axis orientation along which the forces on either side of the rolling rake axis are balanced. According to embodiments of the present disclosure, balancing forces on either side of a rolling rake axis 1040, 1042 may include rotating the rolling rake axis to a position where the type of force of interest (e.g., cutting force, vertical force, and/or radial force) is equal in value, or closer to equal in value than prior to rotating, on either side of the rolling rake axis 1040, 1042.

A rolling rake axis 1040 defined from a force balancing equation may be the same as if defined through a middle of the exposed area 1030, such as shown in FIG. 34, or a rolling rake axis 1042 defined from a force balancing equation may be different than an axis 1044 through a middle of the exposed area 1030, such as shown in FIG. 35.

According to embodiments of the present disclosure, force balancing may be performed on a cutting element level and on a cutting tool level. For example, FIGS. 36 and 37 show schematic representations of force balancing for directional cutting elements 1100 disposed on a bit 1200 at the cutting element level (FIG. 36) and the bit level (FIG. 37).

Figure 36:
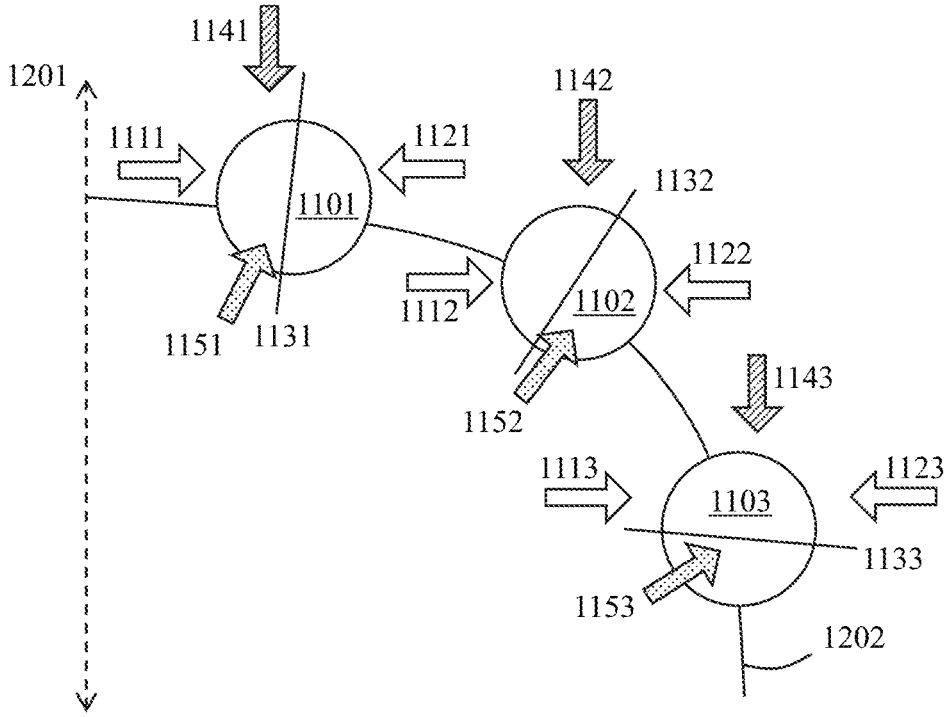
FIGS. 36 and 37 show schematic diagrams from a front view and a top view, respectively, of cutting forces on cutting elements and a bit on which the cutting elements are disposed.
Figure 37:
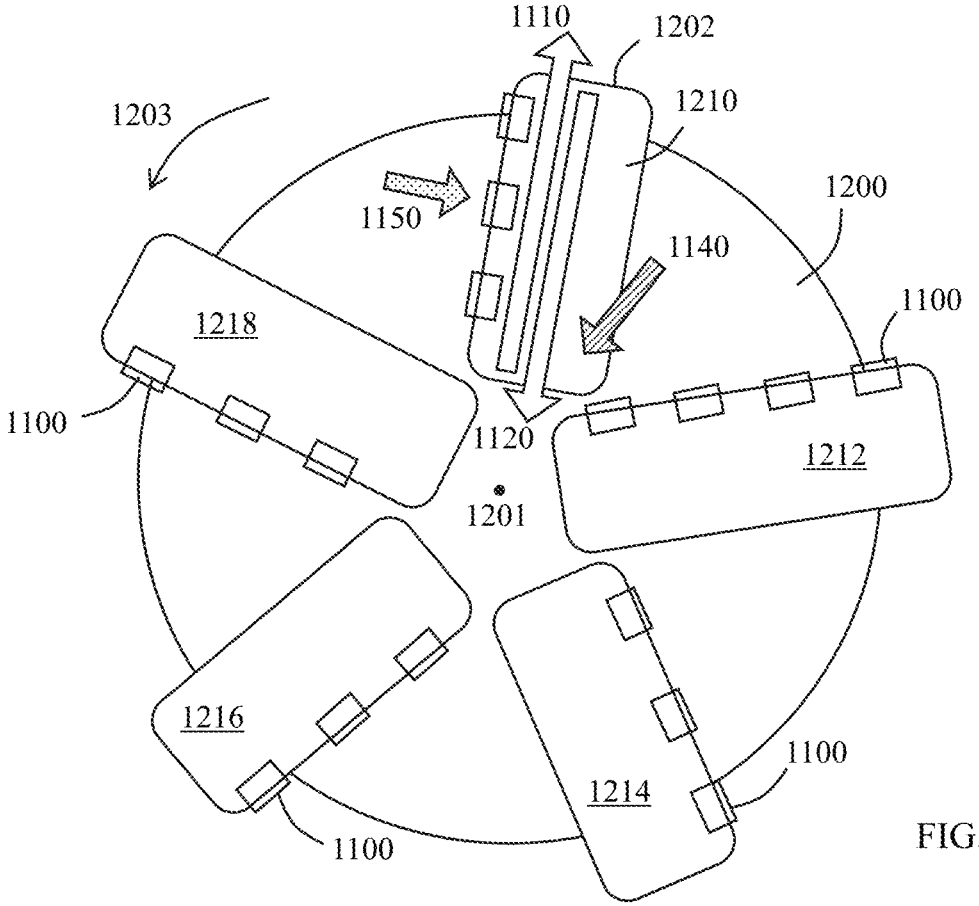

Referring to FIG. 36, force balancing may be performed for individual directional cutting elements 1101, 1102, 1103 (collectively referred to as cutting elements 1100). Although not shown in the schematic representation, the directional cutting elements 1101, 1102, 1103 may include an elongated protrusion (e.g., protrusion 1010 in FIGS. 34 and 35) formed on the cutting face of the cutting elements 1101, 1102, 1103. As discussed above, the elongated protrusion on a directional cutting element 1100 may affect the forces acting on the directional cutting element 1100 depending on the rotational orientation of the elongated protrusion. Other types of cutting elements having one or more protrusions formed on its cutting face may similarly have different types of forces acting on the three-dimensional shape of the cutting face, where the shape and orientation of the geometry of cut along the cutting face as it contacts a formation may affect the magnitudes and types of forces acting on the cutting element.

According to embodiments of the present disclosure, cutting elements having a three-dimensionally shaped cutting face (e.g., directional cutting elements 1000 in FIGS. 34-35, cutting elements 20*a*, 20*b*, 20*c*, 20*d* in FIGS. 21-24, or other cutting elements having one or more protrusions formed on its cutting face) may be rotationally oriented to an aligned rotational orientation where one or more types of forces (e.g., cutting forces, radial forces, vertical forces) acting on the cutting element during operation may be minimized. An aligned rotational orientation of a cutting element having a three-dimensionally shaped cutting face, such as directional cutting elements 1100, may be determined, at least in part, using force balancing calculations to determine the magnitude and type of forces acting on the cutting elements 1100 during operation, and rotating the orientation of the cutting elements 1100 to minimize such force(s). This may include adjusting the rolling rake angle of the cutting elements 1100 by rotating the cutting elements 1100 to an aligned rotational orientation, where forces may be balanced across the rolling rake axes 1131, 1132, 1133 of the cutting elements 1100.

For example, force balancing calculations for individual directional cutting elements 1101, 1102, 1103 may include determining radial forces 1110, 1120 acting on the cutting elements (e.g., the radial forces acting on a three dimension cutting face along the geometry of cut on a cutting element), including determining outward radial forces 1111, 1112, 1113 (radial forces in a direction from a rotational axis 1201 of the bit 1200 toward an outer diameter 1202 of the bit 1200) and inward radial forces 1121, 1122, 1123 (radial forces in an opposite direction from the outward radial forces 1111, 1112, 1113, from the outer diameter 1202 of the bit 1200 toward the rotational axis 1201 of the bit 1200). The outward radial forces 1111, 1112, 1113 and inward radial forces 1121, 1122, 1123 may be added to calculate a net radial force on the directional cutting elements 1101, 1102, 1103. Balancing outward radial forces 1111, 1112, 1113 with inward radial forces 1121, 1122, 1123 may include rotating the individual directional cutting elements 1101, 1102, 1103 to where the net radial force acting on each directional cutting element 1101, 1102, 1103 may be minimized, at which position the rolling rake axis 1131, 1132, 1133 of the cutting elements 1101, 1102, 1103 may be considered in an aligned rotational orientation. Further, balancing outward radial forces 1111, 1112, 1113 and inward radial forces 1121, 1122, 1123 may result in a non-zero net radial force on each directional cutting element 1101, 1102, 1103, where a balanced non-zero net radial force may be smaller than the net radial force prior to balancing.

Referring to FIG. 37, after outward radial forces 1111, 1112, 1113 and inward radial forces 1121, 1122, 1123 are calculated for individual directional cutting elements 1101, 1102, 1103 along a blade 1210 of the bit 1200, the outward radial forces (collectively referred to as outward radial forces 1110) and the inward radial forces (collectively referred to as inward radial forces 1120) may be added together to calculate a blade net radial force. The directional cutting elements 1100 may be rotationally oriented to minimize the blade net radial force to get close to or equal to a blade net radial force of zero. For example, if one or more directional cutting elements (e.g., cutting element 1101) has a net radial force in a radially outward direction, one or more different directional cutting elements on the same blade 1210 of the bit 1200 (e.g., cutting element 1102) may be rotationally oriented to have a net radial force in an opposite radially inward direction of close to or equal to the same magnitude. Each blade 1212, 1214, 1216, 1218 may likewise have the directional cutting elements 1100 thereon rotationally oriented such that the sum of the outward radial forces 1110 and inward radial forces 1120 acting on the cutting elements of each blade 1212, 1214, 1216, 1218 may be close to or equal to zero. In this manner, a bit net radial force may be balanced to have a zero or near-zero bit net radial force.

In some embodiments, directional cutting elements 1100 on a blade 1210 may be rotationally oriented to have a non-zero blade net radial force that counters non-zero blade net radial forces on the remaining blades 1212, 1214, 1216, 1218 of the bit 1200. In embodiments having other types of cutting elements with a three-dimensionally shaped cutting face (e.g., having one or more protrusions formed on the cutting face) and/or other types of bladed downhole cutting tools, the cutting elements may likewise be rotationally oriented to generate non-zero blade net radial forces during operation, such that the blade net radial forces of the blades on the bladed downhole cutting tool are counter-balanced. For example, in bladed downhole cutting tools (e.g., bit 1200) having blades (e.g., 1210) axi-symmetrically positioned around the tool, cutting elements (e.g., cutting elements 1100) may be rotationally oriented to generate non-zero blade net radial forces during operation that are substantially equal, such that the blade net radial force on each blade (e.g., blades 1210, 1212, 1214, 1216, 1218) counter-balance each other. By counter-balancing the blade net radial forces on a bladed downhole cutting tool (e.g., bit 1200), the bit net radial force may be balanced to have a zero or near-zero bit net radial force.

In addition, or alternatively, force balancing on the individual cutting element level and/or bit level may include calculating and minimizing a vertical force 1141, 1142, 1143 (collectively referred to as vertical force 1140) on the directional cutting elements 1100. Vertical force 1140 due to a weight-on-bit (WOB) during operation may be applied on each directional cutting element 1100 of the bit 1200 on which the cutting elements 1100 are disposed. Thus, the sum of the vertical forces 1140 on each directional cutting element 1100 in the bit 1200 may be equal to the WOB for cutting a rock formation.

As shown in FIG. 36, force balancing calculations for individual directional cutting elements 1101, 1102, 1103 may include calculating a vertical force 1141, 1142, 1143 acting on the cutting elements 1101, 1102, 1103 in addition to (or alternatively to) calculating the net radial force on each directional cutting element 1101, 1102, 1103. The directional cutting elements 1101, 1102, 1103 may be rotated to minimize the amount of vertical force 1141, 1142, 1143 acting on each cutting element 1101, 1102, 1103. The vertical forces 1141, 1142, 1143 on each directional cutting element 1101, 1102, 1103 may be added together to get a total vertical force 1140 (shown in FIG. 37). By minimizing the vertical force 1141, 1142, 1143 on individual directional cutting elements 1100, the total vertical force 1140 on the bit 1200 may be lowered, thereby lowering the amount of WOB applied for cutting the rock formation. When a cutting tool is designed to have a lower WOB needed for cutting a rock formation, the cutting tool may drill through a formation faster.

In embodiments where force balancing includes both vertical force and radial force balancing, the directional cutting elements 1101, 1102, 1103 may be rotated to a rotational orientation to where the vertical force 1141, 1142, 1143 is minimized as much as can be without significantly compromising a bit net radial force of zero or near zero.

In addition, or alternatively, force balancing on the individual directional cutting element level and/or bit level may include calculating and minimizing a cutting force 1150 on the directional cutting elements 1100. Referring to FIG. 36, a cutting force 1151, 1152, 1153 on each cutting element 1101, 1102, 1103 may be calculated from the amount of force acting on the cutting face of each directional cutting element 1101, 1102, 1103 in the direction opposite of bit rotation 1203. The directional cutting elements 1101, 1102, 1103 may be rotated to minimize the amount of cutting force 1151, 1152, 1153 acting on each cutting element 1101, 1102, 1103. The cutting forces 1151, 1152, 1153 on each directional cutting element 1101, 1102, 1103 may be added together to get a total cutting force 1150 (shown in FIG. 37). By minimizing the cutting force 1151, 1152, 1153 on individual cutting elements 1100, the total cutting force 1150 on the bit 1200 may be lowered. Further, the torque for each cutting element (e.g., 1101) may be calculated from the radial position of the cutting element 1101 times the cutting force 1151 on the cutting element 1101. The individual torques for each directional cutting element 1100 on the bit 1200 may be added together to calculate the drive torque for the bit 1200. Thus, by minimizing the amount of cutting force 1150 on the directional cutting elements 1100, the drive torque for the bit 120 during cutting a rock formation may be minimized.

Force balancing the cutting force on other types of cutting elements having a three-dimensional cutting face (e.g., cutting elements 20*a*, 20*b*, 20*c*, 20*d*, or other types of cutting elements having one or more protrusions formed on the cutting face) and/or for other types of bladed downhole cutting tools may similarly include rotating the cutting elements to an aligned rotational orientation, where the cutting force during operation is lower than if the cutting element was not in the aligned rotational orientation.

In embodiments where force balancing includes cutting force minimization in addition to vertical force minimization and/or radial force balancing, the directional cutting elements 1101, 1102, 1103 may be rotated to a rotational orientation to where the cutting force 1151, 1152, 1153 may be minimized as much as can be without significantly compromising vertical force 1140 minimization and/or without significantly compromising a bit net radial force of zero or near zero.

Forces on a cutting element 1100 (e.g., radial forces 1110, 1120, vertical forces 1140, and/or cutting forces 1150) may be calculated, for example, by simulating the cutting element on a cutting tool as it cuts a formation.

According to embodiments of the present disclosure, directional cutting elements may be rotationally oriented on a downhole tool so that the cutting faces (e.g., 800, 900) are in an aligned rotational orientation corresponding to predicted exposed areas of the cutting faces in the downhole tool cutting profile. As used herein, an aligned rotational orientation may refer to the rotational orientation of a cutting element when a major axis (e.g., 820, 920) of a protrusion (810, 910) on the cutting face is aligned with a rolling rake axis (840, 940).

For example, methods of designing a downhole tool may include 1) generating a cutting profile (e.g., 700 in FIG. 16) of the downhole tool having one or more directional cutting elements (e.g., 710) thereon, where the directional cutting elements (e.g., 710) have at least one protrusion (e.g., 810, 910 in FIGS. 18 and 19) spaced azimuthally around an edge (e.g., 802, 902) of the cutting face (e.g., 730, 800, 900); 2) using the cutting profile (e.g., 700) to find exposed areas (e.g., 720, 830, 930) on the cutting faces (e.g., 730, 800, 900); 3) defining a rolling rake axis extending radially outward from a longitudinal axis (e.g., 801, 901) of the cutting element; and 4) rotationally orienting the major axis (e.g., 820, 920) of a protrusion (e.g., 810, 910) with the rolling rake axis (e.g., 840, 940) to an aligned rotational orientation.

In some embodiments of the present disclosure, methods of designing and/or manufacturing a downhole tool may include initially aligning a major axis of one or more directional cutting elements with a rolling rake axis. As an example of such embodiments, a cutting profile of a downhole tool may be generated using cutting element blanks, i.e., cutting elements having no defined cutting face geometry. An exposed area on the cutting faces of the cutting element blanks may be determined from the cutting profile. In some embodiments, a rolling rake axis may be drawn extending radially outward from a longitudinal axis of at least one cutting element and through a middle of the exposed area on the cutting element. In some embodiments, the rolling rake axis may be drawn based at least in part on analysis of forces on the exposed area (e.g., geometry of cut) upon interaction of the cutting element with the formation. That is, the rolling rake axis may be determined such that vertical contact forces on the cutting element are reduced and radial cutting forces about the longitudinal axis of the cutting element are balanced.

Directional cutting elements oriented in an aligned rotational orientation on a downhole tool according to embodiments disclosed herein may include cutting faces (e.g., 800, 900) having a protrusion (e.g., 810, 910) that is an elongated protrusion extending linearly along a major axis (e.g., 820, 920) dimension between opposite sides of an edge (e.g., 802, 902) of the cutting element. Other directional cutting elements that may be oriented on downhole tools in an aligned rotational orientation according to the methods disclosed herein may include, for example, cutting faces that have one or more protrusions spaced azimuthally around the edge of the cutting element which may or may not extend through the longitudinal axis of the cutting element and/or cutting faces that have one or more protrusions with a convex or planar top surface. Some examples of directional cutting elements that may be oriented to an aligned rotational orientation according to methods of the present disclosure may include cutting elements disclosed in U.S. Publication No. 2018/0334860, which is incorporated herein by reference. Examples of directional cutting elements that may be oriented to an aligned rotational orientation according to methods of the present disclosure may also include cutting elements having a cutting face with an elongated protrusion having multiple linear extensions extending from a central region of the cutting face toward azimuthally spaced locations around the edge of the cutting face.

By orienting directional cutting elements on a downhole tool according to methods disclosed herein in an aligned rotational orientation, the forces acting on the exposed areas of the directional cutting elements during operation may be reduced enough to influence the rate of penetration of the downhole tool. Further, conventional types of directional cutting elements as well as directional cutting elements according to embodiments of the present disclosure may have improved performance when mounted to a downhole tool according to such methods disclosed herein. For example, FIG. 20 shows a graph comparing the change in vertical forces acting on different types of directional cutting elements 20*a*, 20*b*, 20*c*, 20*d*, shown in FIGS. 21-24, during operation under the same testing conditions, including a depth of cut (DOC) of 0.12" and a back rake angle of 20 degrees in a sample sandstone formation. Vertical force data was collected from cutting simulations using the different types of directional cutting elements, including a conventional first type of directional cutting element 20*a*, a second type of directional cutting element 20*b* (similar to the directional cutting element 400 shown in FIGS. 8 and 9), a third type of directional cutting element 20*c*, and a fourth type of directional cutting element 20*d* (similar to the directional cutting element 300 shown in FIGS. 6 and 7). Using the vertical forces on the conventional first type of directional cutting element 20*a* as a baseline, the graphs show the percent change in vertical forces between the baseline and the second, third and fourth types of directional cutting elements 20*b*, 20*c*, 20*d*. From the collected data, it can be seen that the directional cutting elements 20*b*, 20*c*, 20*d* generally experience lower vertical forces when they are in an aligned rotational orientation than when they are in an offset rotational orientation.

Individually, the vertical force on the second type of directional cutting element 20*b* dropped from an 8 percent change when rotationally oriented at an offset to a−10 percent change when rotationally oriented at an aligned rotational orientation; the vertical force on the third type of directional cutting element 20*c* dropped from a 52 percent change when rotationally oriented at an offset to a 42 percent change when rotationally oriented at an aligned rotational orientation; and the vertical force on the fourth type of directional cutting element 20*d* minimally increased from a−27 percent change when rotationally oriented at an offset to a−26 percent change when rotationally oriented at an aligned rotational orientation.

Further, as represented by the data shown in FIG. 20, it can be seen that directional cutting elements having an elliptical-shaped elongated protrusion according to embodiments of the present disclosure (e.g., the directional cutting element 300 having an elliptical-shaped elongated protrusion 320 shown in FIGS. 6-7) may have less sensitivity to the effect of alignment with a rolling rake angle when compared with other directional cutting elements.

Figure 25:
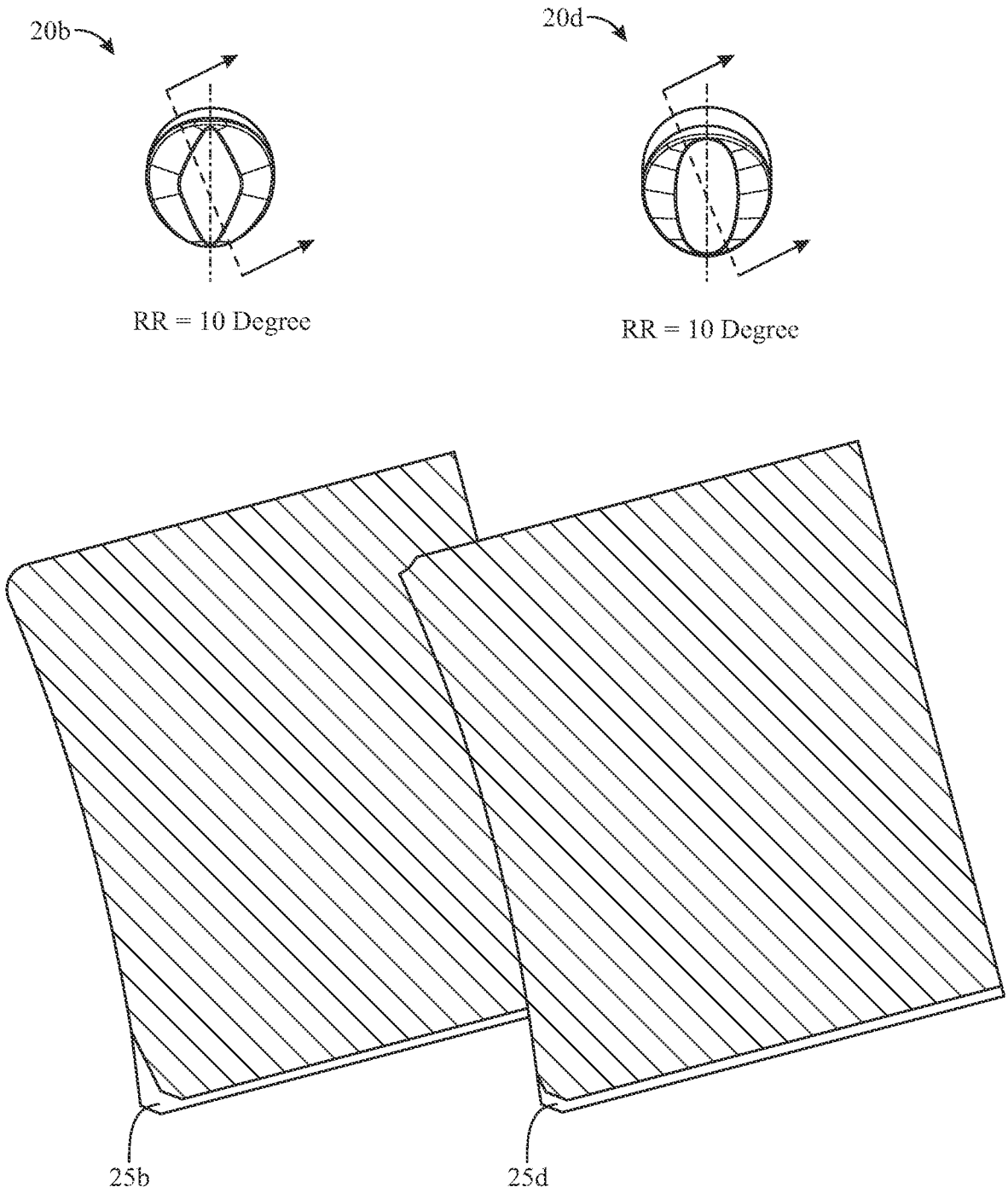
FIG. 25 shows a cross-sectional view of directional cutting elements according to embodiments of the present disclosure comparing their geometry of cut at a rotational offset.

For example, FIG. 25 shows a cross sectional view of the second and fourth types of directional cutting elements 20*b*, 20*d* of FIGS. 22 and 24 comparing the exposed area (e.g., geometry of cut) of the second and fourth types of directional cutting elements 20*b*, 20*d* when the directional cutting elements are offset from a rolling rake axis by 10 degrees. In FIG. 25, the shaded portions 25*b*, 25*d* show the difference or change in profile of the cutting elements from when they are in an aligned rotational orientation to when they are in an offset rotational orientation, where a larger amount of the directional cutting element profile may contact a working surface of the formation when in the aligned rotational orientation. As shown, the difference in profile (shaded portion) 25*b* when the second type of directional cutting element 20*b* is offset is larger than the difference in profile (shaded portion) 25*d* when the fourth type of directional cutting element 20*d* is offset, thus indicating that the fourth type of directional cutting element 20*d* is less sensitive to rolling rake angle than the second type of directional cutting element 20*b*.

Figure 26:
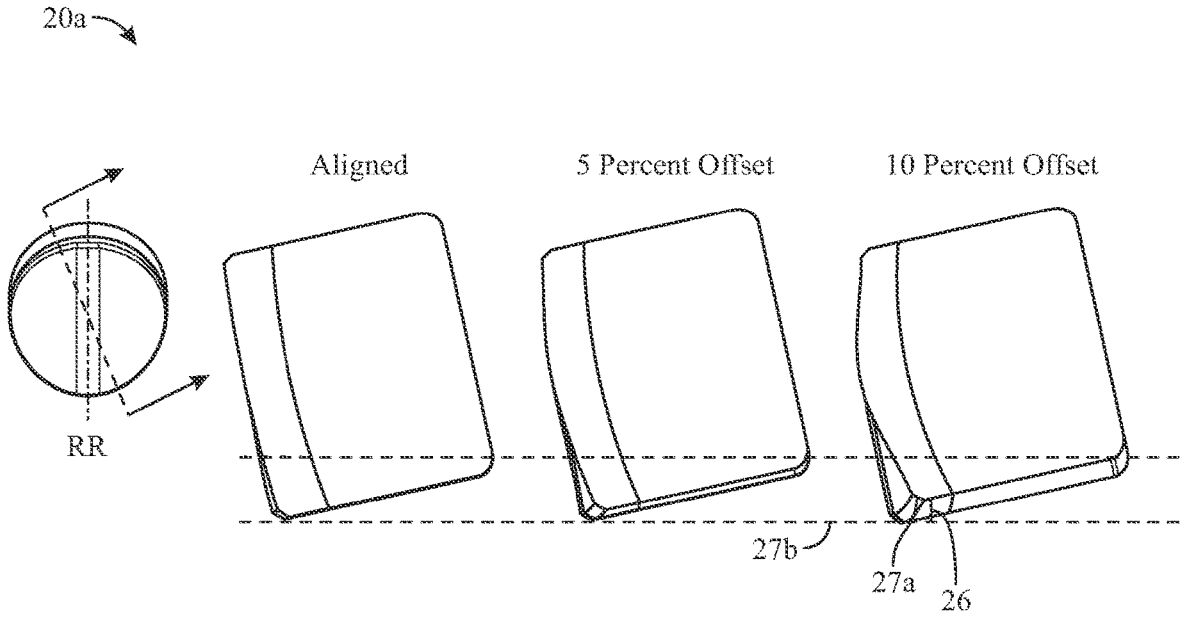
FIGS. 26 and 27 show cross-sectional views of directional cutting elements comparing their geometry of cut at different rotational orientations.
Figure 27:
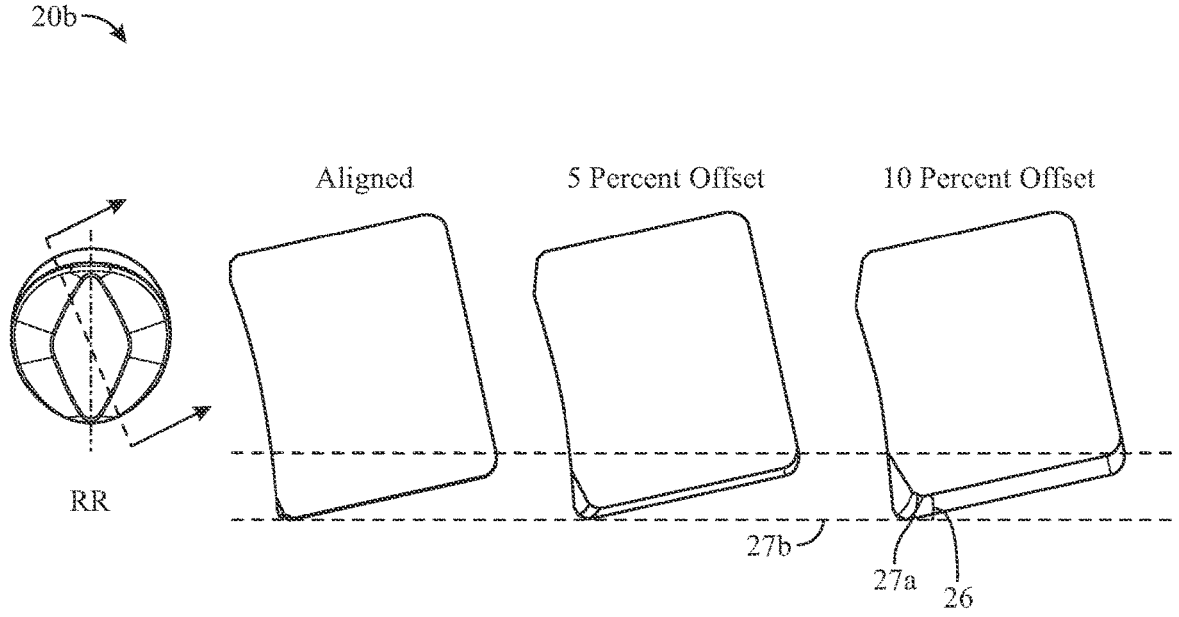

FIGS. 26 and 27 show another comparison of the change in exposed area (e.g., geometry of cut) at different rotational orientations, comparing the first and second types of directional cutting elements 20*a*, 20*b* of FIGS. 21 and 22 at each rotational orientation. In FIG. 26, the change in geometry of cut from the profile of the directional cutting element 20*a* is shown as the rotational orientation of the directional cutting element 20*a* changes from an aligned rotational orientation to a 5 percent rotational offset from the rolling rake axis to a 10 percent rotational offset from the rolling rake axis. In FIG. 27, the change in geometry of cut from the profile of the directional cutting element 20*b* is shown as the rotational orientation of the directional cutting element 20*b* changes from an aligned rotational orientation to a 5 percent rotational offset from the rolling rake axis to a 10 percent rotational offset from the rolling rake axis. As shown, the depth 26 between the cutting edge 27*a* and the working surface 27*b* is greater when the second type of directional cutting element 20*b* is offset than when the first type of directional cutting element 20*a* is offset. This indicates that the first type of directional cutting element 20*a* may be less sensitive to rolling rake angle than the second type of directional cutting element 20*b*.

By using methods according to embodiments of the present disclosure that include determining a rolling rake axis of a directional cutting element and orienting the directional cutting element in an aligned rotational orientation with the rolling rake axis, directional cutting elements that have relatively higher sensitivity to the rolling rake effect may be selected for use on a downhole tool and have improved performance. Conversely, in some embodiments, selection of a directional cutting element having low sensitivity to the rolling rake effect may be beneficial in circumstances when failure of an adjacent cutting element on a downhole tool cutting profile alters the exposed area on a directional cutting element (and thus the rolling rake axis of the directional cutting element). In some embodiments, a first directional cutting element is oriented in a respective first aligned rotational orientation based on a cutting profile, and a second directional cutting element is oriented in a respective second aligned rotational orientation based on the cutting profile, the first aligned rotational orientation is different than the second aligned rotational orientation, and neither aligned rotational orientation is orthogonal to the blade profile. That is, the aligned rotational orientation of cutting elements of a downhole tool may be determined for each cutting element based on the cutting profile. Various factors, such as spiraling, cutting element quantity, size of downhole tool, and position (e.g., nose, cone, shoulder) of the cutting element, among others, may affect the cutting profile.

Figure 28:
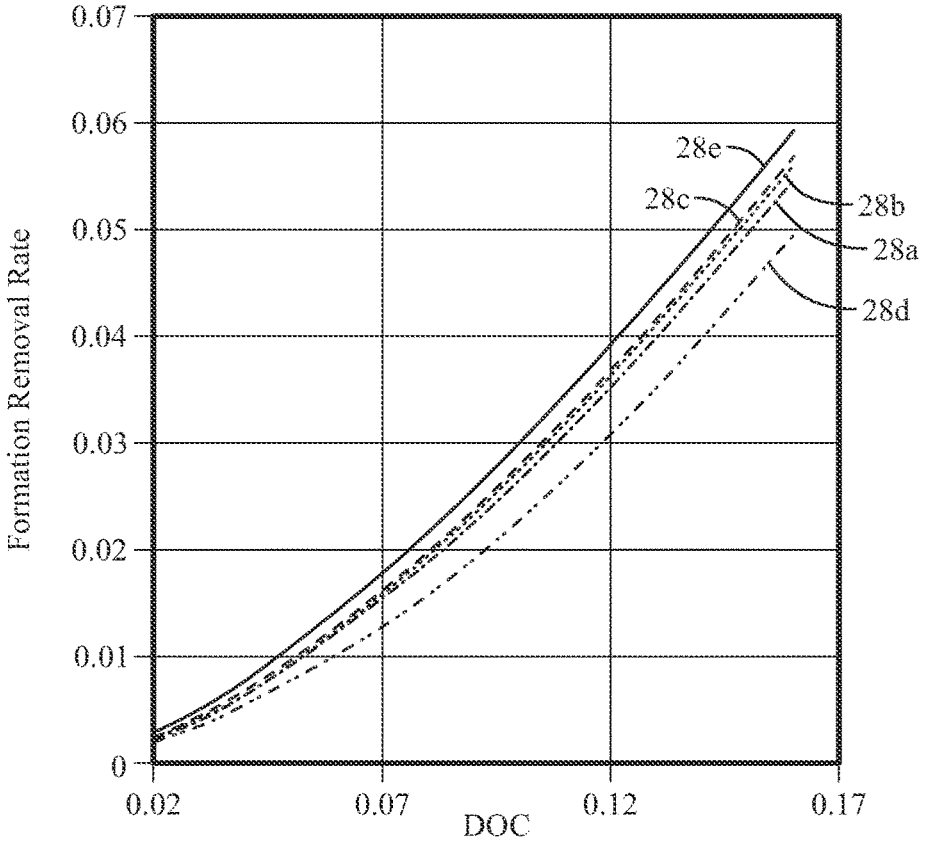
FIG. 28 shows a graph comparing formation removal rate of different types of directional cutting element.
Figure 29:
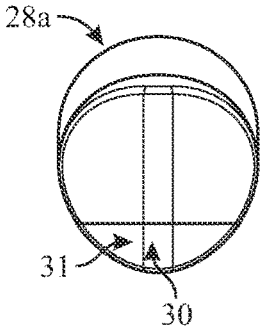
FIG. 29 (Prior Art)
FIGS. 29-33 show the directional cutting elements compared in the graph of FIG. 28.
Figure 30:
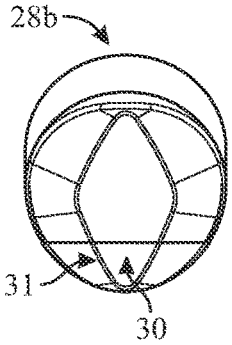
Figure 31:
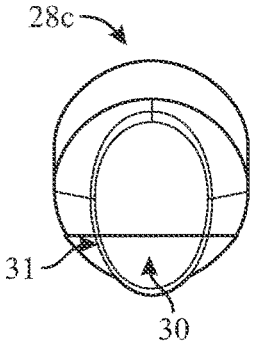
Figure 32:
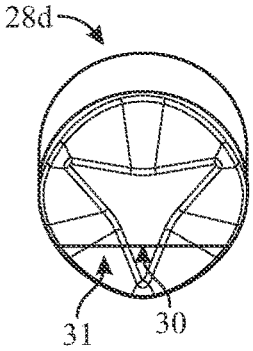
Figure 33:
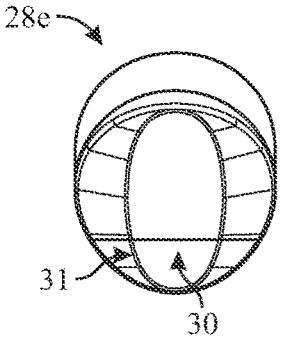

Further, by using some types of directional cutting elements disclosed herein, an improved formation removal rate from improved cutting tip endurance and cutting efficiency may be achieved. For example, FIG. 28 shows a graph comparing the rock removal rate at different depths of cut (DOC) of five types of directional cutting elements, shown in FIGS. 29-33, and including a conventional first type of directional cutting element 28*a*, a second type of directional cutting element 28*b* (similar to the directional cutting element 400 shown in FIGS. 8 and 9), a third type of directional cutting element 28*c* (similar to the directional cutting element 100 shown in FIGS. 2-4), a fourth type of directional cutting element 28*d*, and a fifth type of directional cutting element 28*e* (similar to the directional cutting element 300 shown in FIGS. 6 and 7). When each of the types of directional cutting elements 28*a*-28*e* are oriented at the same back rake angle (e.g., shown at 20 degrees back rake) and at the same depth of cut, the third and fifth types 28*c*, 28*e* have a larger surface area of a protrusion top surface 30 contacting the formation, where the highlighted portions of the directional cutting elements 28*a*-28*e* indicate the contact area 31 between the cutting face of the cutting elements 28*a*-28*e* and the formation. The larger contact area 31 from the protrusion top surface 30 of the third and fifth directional cutting elements 28*c*, 28*e* may improve the endurance of the edge of the cutting element contacting the formation (which may sometimes be referred to as the cutting edge or cutting tip) as well as improve the cutting efficiency.

In the graph showing the formation removal rate under same conditions, the fifth type of directional cutting element 28*e* showed the greatest formation removal rate, the third type of directional cutting element 28*c* showed the second greatest formation removal rate, the second type of directional cutting element 28*b* showed the third greatest formation removal rate, the first type of directional cutting element 28*a* showed the fourth greatest formation removal rate, and the fourth type of directional cutting element 28*d* showed the lowest formation removal rate.

Various methods of manufacturing the shaped cutting elements having elongated protrusions with elliptical- or diamond-shaped top surfaces and as otherwise described herein are known. In some embodiments, elements may be manufactured to a near net shape and used as-pressed (e.g., where the can or mold, in which the element is formed, defines the geometries set out in this application and only surface finishing, if any, is performed). In some embodiments, such elements may be manufactured with a general shape that is then modified (e.g., where a standard cylindrical cutter is formed, then the shape is created via machining or laser cutting to achieve the geometries set out in this application followed by surface finishing). That is, the modification changes the cutter shape from the as-pressed shape.

For a testing sample, standard cylindrical cutting elements were formed. The diamond tables were removed, forming polycrystalline diamond disks. The diamond disks were divided into 2 sub-groups, with each sub-group having 8-10 disks. One sub-group maintained the as-pressed surface. Another sub-group was modified by laser cutting (e.g., the same parameter that could be used when forming shapes as disclosed herein) to remove 0.005" of the top surface of the polycrystalline diamond disk. The transverse rupture strength was evaluated by the ball-on-ring testing method, details of which can be found in Shetty, et al "Biaxial Flexure Tests for Ceramics", Am. Cer. Soc. Bull., 59 [12] 1193-97 (1980). Both groups of disks were subjected to the same testing setup while loading the surface of interest in tension until failure. The as-pressed surface was shown to have an approximately 25% improvement in transverse rupture strength.

In another testing sample, cutting elements having elongated protrusions with elliptical- or diamond-shaped top surfaces as described in this application were manufactured as as-pressed elements and as laser cut elements. Both the as-pressed elements and laser cut elements had the same geometry. That is, the as-pressed elements were formed to a near net shape with the elongated protrusions, and the laser cut elements were first formed with larger geometry, then a laser cutting process removed material from the cutting elements to form the elongated protrusions. The as-pressed elements were finished in preparation for testing by grit blasting to remove the can material and then OD ground and chamfered. The top surface of the as-pressed element was not finished in any way other than the grit blasting. In some embodiments, the as-pressed element may be formed to a near net shape, then grit blasted, OD ground, and chamfered to the net shape. The laser cut elements were formed as a general shape, grit blasted to remove the can material, OD ground and chamfered, and a laser was used to cut the same shape as the as-pressed elements. The impact strength of the elements were tested by impacting the 10 as-pressed elements and 10 laser cut elements against a hardened steel plate until failure, up to a maximum of 30 impacts, on each individual element. This test was performed at a 20 degree back rake angle and with an impact energy of 50J. The impact resistance of the as-pressed element was significantly improved, suggesting that the as-pressed elements have significantly higher impact resistance when shock and vibration is encountered. More specifically, the as-pressed elements endured 20% more impact hits than the laser cut elements, and at the same time, the deviation was reduced about 25%.

In addition to the shock and vibration resistance previously mentioned, the combined impact and flexural strength data give strong evidence that the as-pressed element having elongated protrusions with elliptical- or diamond-shaped top surfaces as described in this application will be more resistant to processes which involve a crack initiation process such as low and high cycle fatigue, thus improving the life of the cutter. While it is believed these benefits can be observed with embodiments according to the present disclosure, other non-planar shapes may see similar impact and flexural strength improvements when compared to similar shapes made by laser cutting.

Thus, by using directional cutting elements according to embodiments disclosed herein, for example, directional cutting elements having elongated protrusions with elliptical- or diamond-shaped top surfaces, improved cutting efficiency and durability of the cutting element may be achieved.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

What is claimed:

1. A cutting element, comprising:

a cutting face at an opposite axial end from a base;

a side surface extending from the base to the cutting face;

an edge formed at the intersection between the cutting face and the side surface;

an elongated protrusion formed at the cutting face and extending between opposite sides of the edge, wherein the elongated protrusion has a geometry comprising:

a border extending around a concave surface, wherein the concave surface comprises:

a major axis dimension measured between opposite sides of the border; and a minor axis dimension measured perpendicularly to the major axis dimension and ranging from 50 percent to 99 percent of the major axis dimension; and a face chamfer formed around the border; and sloped surfaces extending between the border and the edge; and an edge chamfer between the face chamfer and the edge, wherein the sloped surfaces have a steeper slope than the face chamfer and a shallower slope than the edge chamfer.

2. The cutting element of claim 1, further comprising a front rake angle ranging from 5 to 45 degrees, wherein the front rake angle is measured between a radial plane perpendicular to a longitudinal axis of the cutting element and a tangent line to the concave surface, wherein the tangent line extends tangent to the concave surface proximate to the edge and intersects the longitudinal axis.

3. The cutting element of claim 2, wherein the front rake angle ranges from 5 to 15 degrees.

4. The cutting element of claim 1, wherein the border has an ellipse shape.

5. The cutting element of claim 1, wherein the border has a diamond shape.

6. The cutting element of claim 1, wherein the cutting element is an as-pressed element made to a near net shape.

7. The cutting element of claim 1, wherein the cutting element is modified from a cylindrical shape by machining or laser cutting to form the elongated protrusion.

8. The cutting element of claim 1, wherein the major axis dimension is between 60 to 95 percent of a width of the cutting element.

9. The cutting element of claim 1, wherein the elongated protrusion comprises an axial height from the edge, and the concave surface comprises an axially lowest point between 5 to 50 percent of the axial height.

10. The cutting element of claim 1, wherein the elongated protrusion comprises tallest points on opposite ends of the elongated protrusion at the border with the major axis dimension, wherein the axially tallest points comprise an axial height from the edge.

11. A cutting element, comprising:

a cutting face at an opposite axial end from a base;

a side surface extending from the base to the cutting face;

an edge formed at the intersection between the cutting face and the side surface;

an edge chamfer formed between the edge and a border; and an elongated protrusion formed at the cutting face and extending between opposite sides of the edge, wherein the elongated protrusion has a geometry comprising:

the border having a diamond shape extending around a concave surface, wherein the concave surface comprises:

a major axis dimension measured between opposite sides of the border;

a minor axis dimension measured perpendicularly to the major axis dimension and ranging from 50 percent to 99 percent of the major axis dimension;

sloped surfaces extending between the border and the edge;

a face chamfer formed around the border; and a front rake angle ranging from 5 to 30 degrees, wherein the front rake angle is measured between a radial plane perpendicular to a longitudinal axis of the cutting element and a tangent line to the concave surface, wherein the tangent line extends tangent to the concave surface proximate to the edge and intersects the longitudinal axis;

wherein the slopes surfaces have a steeper slope than the face chamfer and a shallower slope than the edge chamfer.

12. The cutting element of claim 11, wherein the major axis dimension is between 60 to 95 percent of a width of the cutting element.

13. The cutting element of claim 11, wherein the cutting element is an as-pressed element made to a near net shape.

14. The cutting element of claim 11, wherein the cutting element is modified from a cylindrical shape by machining or laser cutting to form the elongated protrusion.

15. The cutting element of claim 11, wherein the elongated protrusion comprises an axial height from the edge, and the concave surface comprises an axially lowest point between 5 to 50 percent of the axial height.

16. The cutting element of claim 11, wherein the front rake angle ranges from 5 to 15 degrees.

17. A cutting element, comprising:

a cutting face at an opposite axial end from a base;

a side surface extending from the base to the cutting face;

an edge formed at the intersection between the cutting face and the side surface;

an edge chamfer formed between the edge and a border; and an elongated protrusion formed at the cutting face and extending between opposite sides of the edge, wherein the elongated protrusion has a geometry comprising:

the border extending around a concave surface, wherein the concave surface comprises:

a major axis dimension measured between opposite sides of the border;

a minor axis dimension measured perpendicularly to the major axis dimension and ranging from 50 percent to 99 percent of the major axis dimension;

a face chamfer formed around the border;

sloped surfaces extending between the border and the edge, wherein the sloped surfaces have steeper slope than the face chamfer and a shallower slope than the edge chamfer; and a front rake angle ranging from 5 to 30 degrees, wherein the front rake angle is measured between a radial plane perpendicular to a longitudinal axis of the cutting element and a tangent line to the concave surface, wherein the tangent line extends tangent to the concave surface proximate to the edge and intersects the longitudinal axis.

18. The cutting element of claim 17, wherein the elongated protrusion comprises an axial height from the edge, and the concave surface comprises an axially lowest point between 5 to 50 percent of the axial height.

19. The cutting element of claim 17, wherein the cutting element is an as-pressed element made to a near net shape.

20. The cutting element of claim 17, wherein the major axis dimension is between 60 to 95 percent of a width of the cutting element.

* * * * *